US012540525B2

(12) United States Patent
Zakharia et al.

(10) Patent No.: US 12,540,525 B2
(45) Date of Patent: Feb. 3, 2026

(54) HYBRID DISSOLVABLE PLUGS FOR SEALING DOWNHOLE CASING STRINGS

(71) Applicant: G&H Diversified Manufacturing LP, Houston, TX (US)

(72) Inventors: Steven Zakharia, Houston, TX (US); Joshua Magill, Cypress, TX (US); Ryan Ward, Tomball, TX (US)

(73) Assignee: G&H Diversified Manufacturing LP, Houston, TX (US)

( * ) Notice: Subject to any disclaimer, the term of this patent is extended or adjusted under 35 U.S.C. 154(b) by 0 days.

(21) Appl. No.: 18/103,247

(22) Filed: Jan. 30, 2023

(65) Prior Publication Data

US 2023/0243231 A1 Aug. 3, 2023

Related U.S. Application Data

(60) Provisional application No. 63/305,250, filed on Jan. 31, 2022.

(51) Int. Cl.

| | |
|---|---|
| ***E21B 33/12*** | (2006.01) |
| ***E21B 29/00*** | (2006.01) |
| ***E21B 43/116*** | (2006.01) |

(52) U.S. Cl.

CPC ..... *E21B 33/1208* (2013.01); *E21B 29/00* (2013.01); *E21B 43/116* (2013.01); *E21B 2200/08* (2020.05)

(58) Field of Classification Search

CPC .... E21B 33/1208; E21B 29/00; E21B 43/116; E21B 2200/08

See application file for complete search history.

(56) References Cited

U.S. PATENT DOCUMENTS

| | | | | |
|---|---|---|---|---|
| 5,271,468 | A * | 12/1993 | Streich | E21B 33/1293 166/134 |
| 2016/0230494 | A1* | 8/2016 | Fripp | C22C 23/02 |
| 2016/0356137 | A1* | 12/2016 | Hardesty | E21B 43/26 |
| 2018/0216431 | A1* | 8/2018 | Walton, III | E21B 23/06 |
| 2019/0162050 | A1* | 5/2019 | Fripp | C09K 8/508 |
| 2020/0347694 | A1* | 11/2020 | Power | E21B 23/06 |

* cited by examiner

*Primary Examiner* — Nicole Coy
*Assistant Examiner* — Nicholas D Wlodarski
(74) *Attorney, Agent, or Firm* — Conley Rose, P.C.

(57) ABSTRACT

A plug deployable into a wellbore having a casing string includes a sealing element including an outer sealing surface configured to extend outwardly from a central axis of the plug and sealingly press against a casing string when the plug is in the second configuration, and a slip including at least one slip body having a peripheral outer face oriented to face away from the central axis and towards the casing string, and one or more engagement members located on the outer face of the slip body wherein the one or more engagement members are configured to bite into the casing string when the plug is in the second configuration, wherein at least 40% of a total volume of the plug is formed from corrosion-selected materials and at least 30% of the total volume of the plug is formed from corrosion-resistant materials.

22 Claims, 8 Drawing Sheets

HYBRID DISSOLVABLE PLUGS FOR SEALING DOWNHOLE CASING STRINGS

CROSS-REFERENCE TO RELATED APPLICATIONS

This application claims benefit of U.S. provisional patent application Ser. No. 63/305,250 filed Jan. 31, 2022, and entitled "Hybrid Dissolvable Plugs for Sealing Downhole Casing Strings," which is hereby incorporated herein by reference in its entirety for all purposes.

STATEMENT REGARDING FEDERALLY SPONSORED RESEARCH OR DEVELOPMENT

Not applicable.

BACKGROUND

Hydrocarbons may be produced by drilling a wellbore into a subterranean earthen formation to provide fluid conductivity between the wellbore and a hydrocarbon bearing reservoir contained in the earthen formation. In some applications, the wellbore may be supported by a tubular casing string (also referred to simply as "casing") which extends to the bottom or toe of the wellbore. Cement is typically pumped into the annular interface formed between the sidewall of the wellbore and the exterior of the casing string to secure and seal the casing string to the wellbore. In this arrangement, the casing string is then perforated at one or more desired locations within the wellbore. For example, the casing string should be perforated at a plurality of distinct locations to provide fluid communication from the target hydrocarbon production zone into an interior central passage of the casing string.

In many applications, the casing string is perforated by use of a wireline-deployed tool string including one or more perforating guns and a downhole "frac" plug to provide zonal isolation. For example, the tool string, suspended from a wireline, is lowered from the surface and pumped down through the casing string to a desired location within the wellbore. Once at the desired location, the frac plug of the tool string is activated or "set" whereby slips of the frac plug press against the inside of the casing and bite into the wall of the casing string, securing the frac plug at the desired location. Concurrently with the setting of the slips, a sealing element or "packer' positioned on the outside of the frac plug presses outwardly and seals against the inside of the casing wall, thereby fluidically isolating an uphole portion of the casing string from a downhole portion of the casing string below the frac plug so that fluids pumped down through the casing string from the surface are not permitted to flow into the downhole portion of the casing string. Setting the plug also disconnects the plug from the remainder of the tool string so that the perforating guns may be positioned for perforating the casing string at desired locations uphole from the plug. With the perforating guns positioned as desired in the casing string, the perforating guns are fired, creating punctures or perforations into the casing string uphole from the plug.

Following the firing of the perforating guns, the tool string is retrieved to the surface and hydraulic fracturing or "fracking" fluid is pumped down through the casing string at high pressure to enlarge and extend the perforations outside the casing string. The fracturing fluid flowing down through the casing string is prevented from flowing into the downhole portion of the casing string by the set plug and instead is forced through the perforations in the casing string to hydraulically fracture the earthen formation. The fracturing of the earthen formation enhances the expected productivity of hydrocarbons from the wellbore. It should be noted that, in order to maintain the elevated fluid pressures required to fracture the formation, only a limited number of fractures may be formed in the formation at a single time. Additionally, wellbores typically have a long contact interface with a target formation with an extensive number of perforations. So, it is understandable that the process of plugging, perforating and hydraulically fracturing the earthen formation is typically repeated at many locations along the wellbore.

Once all of the plugs have been set and all the perforations have been fracked, the casing string must be cleared to allow for the installation of the production string into the casing string. This process principally includes clearing each of the plugs set within the casing string. In some applications, the plugs are removed by drilling using a coiled tubing drilling system that is brought to the wellsite after the wireline rig used to deploy the tool string and fracking systems used to pump the fracking fluid have been removed from the wellsite. The process of drilling out each of the plugs takes time where time translates to substantial added costs for completing the wellbore.

Additionally, a number of different issues typically complicate and delay the process of drilling out the plugs from the casing string. As an example, a first source of drilling delay is the inability or limited ability to put weight on the drill bit used to drill out the plugs. Particularly, most drill bits used for this type of process are of the tri-cone variety, and having the drill bit pressed firmly to each of the plugs typically speeds the drilling process. Considering the many highly perforated and fracked wellbores are long deviated wellbores having long horizontal runs sometimes extending for multiple miles horizontally it is common for coiled tubing deployed therein to snake and/or kink when tophole pressure applied to the coiled tubing is high. The snaking and/or kinking of the coiled tubing naturally reduces the amount of weight on the drill bit. Thus, the plugs far along the wellbore will generally take more time to drill out compared to plugs in the uphole vertical portion of the wellbore directly below the coiled tubing rig from which the drill bit is deployed.

A second type of difficulty encountered in drilling out the set plugs is when components of a given plug get caught up with the teeth of the spinning drill bit and spin in unison with the drill bit—a phenomenon termed "free spin," which typically occurs with parts of the plug that have broken away from the slips attached to the casing string. Many plug designs prevent rotation of the components of the plug so long as they remain attached to the slips. However, typically, a nose located at downhole end of the plug is free to spin once the slips it is connected to are drilled out given that the drill bit will engage the slips (positioned uphole from the nose) before fully engaging the nose. This situation is particularly frustrating when the nose of a first plug drops to the next plug downhole from the first plug and prevents the teeth of the drill bit from engaging and gouging out that next plug with the teeth being covered by the nose of the first plug. The nose of the first plug simply spins in unison with the drill bit as it is pressed against an uphole end of the next plug without the teeth of the drill bit engaging the next plug.

To avoid the risks of delays for drilling, including the exemplary issues outlined above, some plugs are formed of dissolvable materials configured to corrode and/or dissolve when exposed to chlorinated aqueous solutions at elevated temperatures. Such materials include magnesium and/or aluminum alloys and the corrosion is undertaken using hot chlorinated aqueous solutions injected into the casing string as part of a fracking operation in which the wellbore is plugged, perfed, and fracked. Such dissolvable frac plugs dissolve after a relatively known period of time and can be undertaken such that the plugs located near the bottom or toe of the wellbore begin to corrode while frac plugs positioned uphole are being installed for perforating ("perfing") and fracking operations. While the corrosion-selected materials are often substantially more expensive than the corrosion-resistant materials (e.g., steel alloys, composites, etc.) comprising common frac plugs, the need for the drill out operation is avoided. For example, dissolvable frac plugs may cost twice or more than a comparably configured corrosion-resistant frac plug which must be drilled out at the conclusion of the fracking operation. For at least this reason, dissolvable frac plugs are typically only utilized in applications in which it would a smaller number of plugs have been installed. For a limited number of plugs, it is a lower cost to use more expensive plugs. But for longer wellbores having more plugs, the mobilization costs for the coiled tubing are justified for drilling out the corrosion-resistant plugs as long as there are not prolonged delays at each plug. Typically, the wells that use lower cost plugs and drill them out are wellbores with an especially long horizontal section.

In addition to costing more, dissolvable frac plugs may introduce additional issues in the fracking operation. As an example, the process of drilling out a given corrosion-resistant plug provides a positive indication to an operator of the drilling system that the plug successfully attached to the casing string at the predetermined position when the given plug was originally set. Particularly, in some instances, a plug may not successfully attach to the casing string upon being set. In such an instance, the loose plug is typically inadvertently pumped by the fracking fluid through the casing string until it lands against the next plug located downhole from the loose plug. Having landed against the next plug, the loose plug exposes the previously fractured perforations to the fracking fluid and thereby prevents the next set of perforations from being fracked as the fracking fluid is instead diverted through the now exposed and previously fractured perforations.

The failure of the loose plug to attach to the casing string and the concomitant failure to fracture the set of perforations associated with the loose plug may remain unknown until the loose plug is drilled out by the drilling system. Particularly, the operator of the drilling system may register at the surface engagement between the drill bit and a plug in terms of increased weight on bit as the drill bit presses against the plug. The operator of the drilling system may thus infer the presence of a loose plug when the drill bit engages two plugs positioned directly adjacent each other in the casing string. It may be further inferred that perforations located uphole of the loose plug were not successfully fracturing during the fracking operation and thus it may be desired to re-frack that portion of the casing string to maximize production from the wellbore. However, this surface indication is not provided in applications in which the plugs are dissolved rather than drilled out, preventing an operator of the wellbore from discovering that a portion of the casing string has not been successfully fracked which may in-turn reduce the productivity of the wellbore. Thus, while the time savings associated with dissolvable plugs provide an advantage over corrosion-resistant plugs, forgoing the process of drilling out the plugs also has downsides which may reduce the productivity of the wellbore once it has been placed into production.

As outlined above, the hydrocarbon production industry seeks lower cost and lower risk options for drilling and producing wellbores and technology for more reliably and quickly drilling out low-cost plugs would be well received.

SUMMARY

An embodiment of a plug deployable as part of a tool string into a wellbore having a casing string positioned therein comprises an annular sealing element comprising a radially outer sealing surface configured to extend outwardly from a central axis of the plug and sealingly press against an inner surface of the casing string when the plug is in the second configuration, a slip extending comprising at least one slip body having a peripheral outer face oriented to face away from the central axis and toward the casing string, and one or more engagement members located on the outer face of the slip body wherein the one or more engagement members are configured to bite into the casing string when the plug is in the second configuration to thereby resist axial movement of the slip relative to the casing string, and a nose having an annular nose body located at a downhole end of the plug, wherein the nose is configured to apply an axially directed force against the sealing element to force the sealing surface of the sealing element into sealing engagement with the casing string when the plug is in the second configuration, wherein the annular nose body of the nose comprises a corrosion-selected material and is configured to dissolve following a predetermined delay period, and the one or more slip bodies of the slip are formed from a corrosion-resistant material. In some embodiments, the annular nose body comprises at least one of a magnesium alloy and an aluminum alloy. In some embodiments, the annular nose body comprises a corrosion-resistant coating encapsulating the corrosion-selected material. In certain embodiments, the plug comprises an elongate mandrel having a first end, a second end longitudinally opposite the first end, and an outer surface extending from the first end to the second end, wherein the first end is configured to connect to a setting tool of the tool string for actuating the plug from a first configuration to a second configuration, and a slip retainer having an annular retainer body extending around the outer surface of the mandrel and having an annular engagement surface in contact with an end of the slip, and wherein the slip is positioned axially between the slip retainer and the sealing element, wherein the annular retainer body comprises a corrosion-selected material configured to dissolve following a predetermined delay period. In certain embodiments, the plug comprises a ramp having an annular ramp body having an inclined engagement surface extending at an acute angle radially outwards from the central axis, and wherein a radially inner surface of the at least one slip body of the slip is positioned on the inclined engagement surface when the plug is in the second configuration, wherein the annular ramp body comprises a corrosion resistant material. In some embodiments, at least 40% of a total volume of the plug is formed from corrosion-selected materials and at least 30% of the total volume of the plug is formed from corrosion-resistant materials. In some embodiments, more than 50% of a total volume of the plug is formed from corrosion-selected materials.

An embodiment of a plug deployable as part of a tool string into a wellbore having a casing string positioned therein comprises an annular sealing element comprising a radially outer sealing surface configured to extend outwardly from a central axis of the plug and sealingly press against an inner surface of the casing string when the plug is in the second configuration, and a slip comprising at least one slip body having a peripheral outer face oriented to face away from the central axis and towards the casing string, and one or more engagement members located on the outer face of the slip body wherein the one or more engagement members are configured to bite into the casing string when the plug is in the second configuration to thereby resist axial movement of the slip relative to the casing string, wherein at least 40% of a total volume of the plug is formed from corrosion-selected materials and at least 30% of the total volume of the plug is formed from corrosion-resistant materials. In some embodiments, more than 50% of a total volume of the plug is formed from corrosion-selected materials. In some embodiments, at least 60% of a total volume of the plug is formed from corrosion-selected materials. In certain embodiments, the plug comprises a nose having an annular nose body located at a downhole end of the plug, wherein the nose is configured to apply an axially directed force against the sealing element to force the sealing surface of the sealing element into sealing engagement with the casing string when the plug is in the second configuration, wherein the annular nose body of the nose comprises a corrosion-selected material. In certain embodiments, the corrosion-selected materials comprise at least one of a magnesium alloy and an aluminum alloy. In some embodiments, the corrosion-selected materials are encapsulated in a corrosion-resistant coating. In some embodiments, the plug comprises an elongate mandrel having a first end, a second end longitudinally opposite the first end, and an outer surface extending from the first end to the second end, wherein the first end is configured to connect to a setting tool of the tool string for actuating the plug from a first configuration to a second configuration, a slip retainer having an annular retainer body extending around the outer surface of the mandrel and having an annular engagement surface in contact with an end of the slip, and wherein the slip is positioned axially between the slip retainer and the sealing element, wherein the annular retainer body comprises a corrosion-selected material configured to dissolve following a predetermined delay period. In certain embodiments, the plug comprises a ramp having an annular ramp body having an inclined engagement surface extending at an acute angle radially outwards from the central axis, and wherein a radially inner surface of the at least one slip body of the slip is positioned on the inclined engagement surface when the plug is in the second configuration, wherein the annular ramp body comprises a corrosion resistant material.

An embodiment of a method for preparing a cased subterranean wellbore for the production of subterranean fluids comprises (a) deploying a tool string to a desired location within the casing string positioned in the wellbore, the tool string comprising one or more perforating guns, a setting tool, and a downhole-deployable plug having a central axis, wherein the plug comprises an annular sealing element, a slip comprising at least one slip body having a radially outer face, a nose comprising an annular nose body located at a downhole end of the plug, and one or more engagement members located on the outer face of the slip body, (b) actuating the setting tool with the tool string located at the desired location whereby the plug is actuated from a first configuration to a second configuration in which the one or more engagement members of the slip attach to the casing string and a radially outer sealing surface of the sealing element enters into sealing contact with the casing string such that fluid flow across the plug is restricted in at least one axial direction, (c) activating the perforating gun of the tool string to form one or more perforations in the casing string at a location uphole from the plug, (d) pumping a completion fluid from the casing string, through the one or more perforations formed by the perforating gun, and into an earthen formation, (e) dissolving the annular nose body of the plug following (d) in response to the nose being exposed to ambient conditions within the casing string, and (f) deploying a drill into the casing string and drilling out the attached slip to reduce an obstruction to fluid flow through the casing string formed by the attached slip. In some embodiments, at least 40% of a total volume of the plug is formed from corrosion-selected materials and at least 30% of the total volume of the plug is formed from corrosion-resistant materials. In some embodiments, more than 50% of a total volume of the plug is formed from corrosion-selected materials. In certain embodiments, the method comprises (g) applying an axially directed force by the nose against the sealing element to force the sealing surface of the sealing element into sealing engagement with the casing string. In certain embodiments, actuating the setting tool results in the disconnection of the plug from the tool string following the actuation of the plug into the second configuration.

An embodiment of a method for preparing a cased subterranean wellbore for the production of subterranean fluids comprises (a) performing multiple hydraulic fracturing operations in a progression moving from a downhole end of the wellbore toward an uphole end wherein each fracturing operation comprises (i) deploying a unique tool string into the wellbore to a unique pre-determined location within the casing string located in the wellbore, the tool string comprising at least one perforating gun, a setting tool, and a hybrid frac plug located at a downhole end of the tool string wherein the hybrid frac plug includes a nose, an annular sealing element, and at least one slip, between the ends of the hybrid frac plug is located the sealing element and the at least one slip where the sealing element extends continuously circumferentially around a central axis of the hybrid frac plug along an outer periphery of the hybrid frac plug, (ii) actuating the setting tool to impose axially directed forces against the sealing element of the hybrid frac plug to set the hybrid frac plug and transition the sealing element and slip assembly from a run in configuration to a sealing configuration where slip assembly bites into the casing string resisting relative movement between the casing string and the hybrid frac plug while the sealing element extends towards and sealingly presses against an inner surface of the casing preventing fluid flow across the hybrid frac plug in at least a downhole direction, (iii) detaching the hybrid frac plug from the tool string, (iv) firing the at least one perforating gun to puncture perforations in the casing string, and (v) pressurizing the portion of the casing string located uphole from the hybrid frac plug with hydraulic fracturing fluid to fracture, expand and extend the perforations into a subterranean earthen formation surrounding the wellbore while the hybrid frac plug prevents the pressurized fracturing fluid from proceeding further through the casing string downhole from the hybrid frac plug, (b) dissolving the nose of each of the hybrid frac plugs no sooner than six hours after each the hybrid frac plugs have been set while the slip assembly and sealing element of each hybrid frac plug is preserved in place as set after each of the hybrid frac plugs have been set, (c) clearing the casing string of the at least one slip and the sealing element of each of the hybrid frac plugs with a drill system where the drill system whereby engagement between a drill bit of the drill system and the at least one slip and the sealing element of each hybrid frac plug is registered as an increase in resistance to the downhole progression of the drill bit through the casing string, (d)

determining a position of each of the hybrid frac plugs estimated from the registered increase in resistance to the downhole progression of the drill bit, and (e) comparing the determined position of each of the hybrid frac plugs with a predetermined location of each of the hybrid frac plugs in the casing string to determine if any of the hybrid frac plugs have moved axially within the casing string after being transitioned to the sealing configuration.

BRIEF DESCRIPTION OF THE DRAWINGS

For a detailed description of exemplary embodiments of the disclosure, reference will now be made to the accompanying drawings in which.

DETAILED DESCRIPTION

Figure 1:
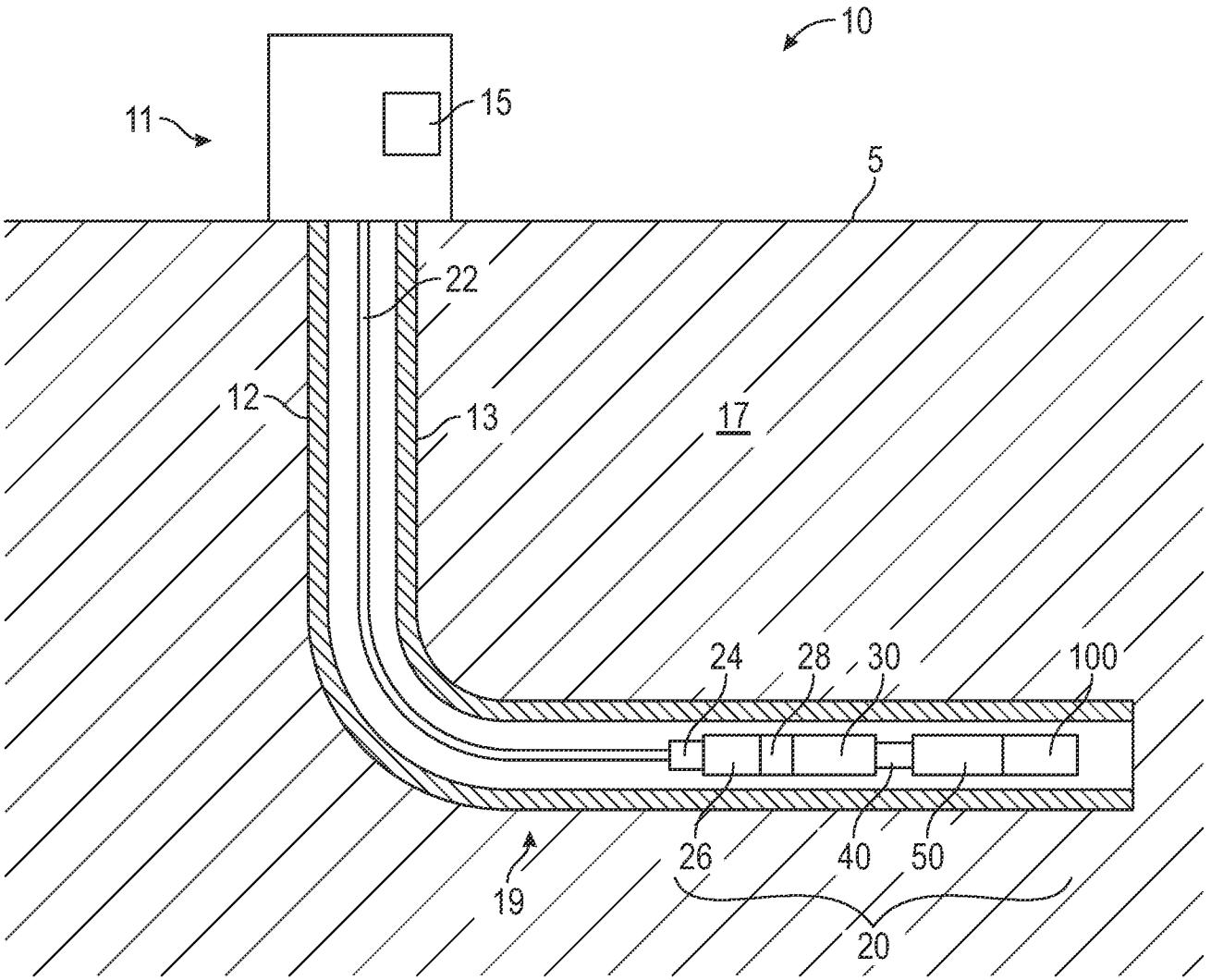
FIG. 1 is a schematic, view of an embodiment of a system for completing a subterranean well.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment. Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . " Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. Any reference to up or down in the description and the claims is made for purposes of clarity, with "up", "upper", "upwardly", "uphole", or "upstream" meaning toward the surface of the borehole and with "down", "lower", "downwardly", "downhole", or "downstream" meaning toward the terminal end of the borehole, regardless of the borehole orientation. Further, the term "fluid," as used herein, is intended to encompass both fluids and gasses.

As described above, frac plugs utilized to provide zonal isolation of a wellbore as part of a fracking operation include corrosion-resistant frac plugs which must be drilled out at the conclusion of the fracking operation, and dissolvable frac plugs configured to corrode and dissolve after a predetermined period of time such that the dissolvable frac plugs need not be drilled out for removal. While dissolvable frac plugs eliminate the requirement of drilling the frac plugs out at the conclusion of the fracking operation, dissolvable frac plugs, because of the corrosion-selected materials of which they are comprised, are substantially more expensive than conventional corrosion-resistant frac plugs and thus are typically only utilized in applications unsuitable for corrosion-resistant frac plugs (e.g., for wellbore having long horizontal sections which may be difficult to reach by a coiled tubing-deployed drill). For example, dissolvable frac plugs may cost twice that or more compared to similarly configured corrosion-resistant frac plugs.

Accordingly, embodiments of hybrid downhole or "frac" plugs are disclosed herein which include components that are selected to be formed of corrosion-resistant and other components are selected to be formed of dissolvable components wherein the combination of dissolvable and corrosion resistant components are designed to better optimize completion costs and minimize operational issues associated with both conventional corrosion-resistant plugs (e.g., complications with drilling out free-spinning components, etc.) and dissolvable plugs (e.g., lack of surface indication of a loose plug in the casing string). Specifically, the inventive plugs described herein minimize the difficulty in drilling out the casing string after plugging and perfing operations are completed while only minimally increasing the material costs as compared to the substantially more expensive conventional dissolvable plugs that are used to minimize or avoid drill out costs. Particularly, the type of materials (e.g., corrosion-resistant versus dissolvable) from each component of the hybrid frac plug is formed is strategically selected based on, among other things, the ease of drilling out the particular component, the increase in costs associated with forming the given component from dissolvable materials, and other factors. For example, the inventive hybrid dissolvable frac plugs disclosed herein may include one or more slips formed from a relatively inexpensive corrosion-resistant materials along with a nose or nose formed from a dissolvable material. The slips are designed to bind and bite against an inner surface or wall of the casing string and thus may be relatively easy to drill out while adhering to the casing string and vulnerable to the teeth of the drill bit of a drilling system. At the same time, the nose which is prone to free-spinning within the casing string making the nose relatively more difficult to drill out at the conclusion of the fracking operation. By strategically selecting and designing the components with which type of material (e.g., corrosion-resistant versus dissolvable) a hybrid dissolvable frac plug is created that can provide an equipment solution that is relatively easy and risk free to drill out at a fraction of the equipment cost compared to conventional dissolvable frac plugs.

Referring now to FIG. 1, a hydrocarbon production location is shown with wellbore 13 extending into a subterranean earthen formation 17 with a generally horizontal section 19 arranged in a target area of the earthen formation 17 that is anticipated to contain commercial quantities of hydrocarbons. A fracking system 10 is also shown in FIG. 1 for perfing and fracking the wellbore 13, as will be discussed further herein. Wellbore 13 is a cased wellbore including a casing string 12 secured and sealed to an inner surface or sidewall of the wellbore 13 using cement (not shown). In this exemplary embodiment, the casing string 12 generally includes a plurality of tubular segments or casing joints coupled together via a plurality of casing collars. Fracking system 10 includes a surface assembly 11 positioned at the surface 5, and a tool string 20 deployed into the wellbore 13 from the surface 5. Surface assembly 11 typically includes a wireline truck and an array of fracking equipment but may comprise any suitable surface equipment for drilling, completing, and/or operating well 20 and may include, in some embodiments, derricks, structures, pumps, wireline reel, wireline injector, electrical/mechanical well control components, etc. Tool string 20 of fracking system 10 is suspended within wellbore 13 from a wireline 22 that extends from surface assembly 11. Wireline 22 comprises an armored cable and includes at least one electrical conductor for transmitting power and electrical signals between tool string 20 and a control system or firing panel 15 of surface assembly 11.

Tool string 20 is generally configured to perforate the casing string 12 to provide for fluid communication between the earthen formation 17 and the wellbore 13 at one or more predetermined locations and to allow for hydraulic fracturing of the formation 17 and the subsequent production of hydrocarbons from the formation 17 into the wellbore 13. In this exemplary embodiment, tool string 20 generally includes a cable head 24, a casing collar locator 26, a direct connect sub 28, a perforating tool or gun 30 (typically a number of perforating guns 30), a setting tool initiator or firing head 40, a setting tool 50, and a downhole-deployable hybrid frac plug 100. It should be understood that in other embodiments the configuration of tool string 20 may vary from that shown in FIG. 1. It may also be understood that tool string 20 may include additional components not shown in FIG. 1.

In this exemplary embodiment, cable head 24 is the uppermost component of tool string 20 and includes an electrical connector for providing electrical signal and power communication between the wireline 22 and the other components of tool string 20 all the way to the downhole plug 60. The perforating gun 30 of tool string 20 includes one or more explosive charges that may be detonated in response to the transmission of one or more electrical signals conveyed by the wireline 22 from the firing panel 15 of surface assembly 11. Upon detonation, the one or more shaped charges of perforating gun 30 produce one or more corresponding explosive jets directed against casing string 12 which perforates the casing string 12, providing access to the earthen formation 17.

The firing head 40 of tool string 20 is connected to the setting tool 50 and is configured to initiate the activation of setting tool 50. For example, firing head 40 typically includes an explosive initiator which is detonated in response to a signal where the setting tool 50 of tool string 20 actuates the frac plug 100 to modify its shape from a first or run-in configuration to a second, set, or deployed configuration. As will be discussed further herein, frac plug 100 is configured to both attach or bind or bite to the casing string 12 and also to seal against the casing string 12 as it transforms from the run-in configuration to the deployed configuration. In the deployed configuration the upper portion of the casing string is sealed; and isolated from the portion of casing string 12 extending below the plug on downhole to a terminus or toe of the wellbore 13.

Figure 2:
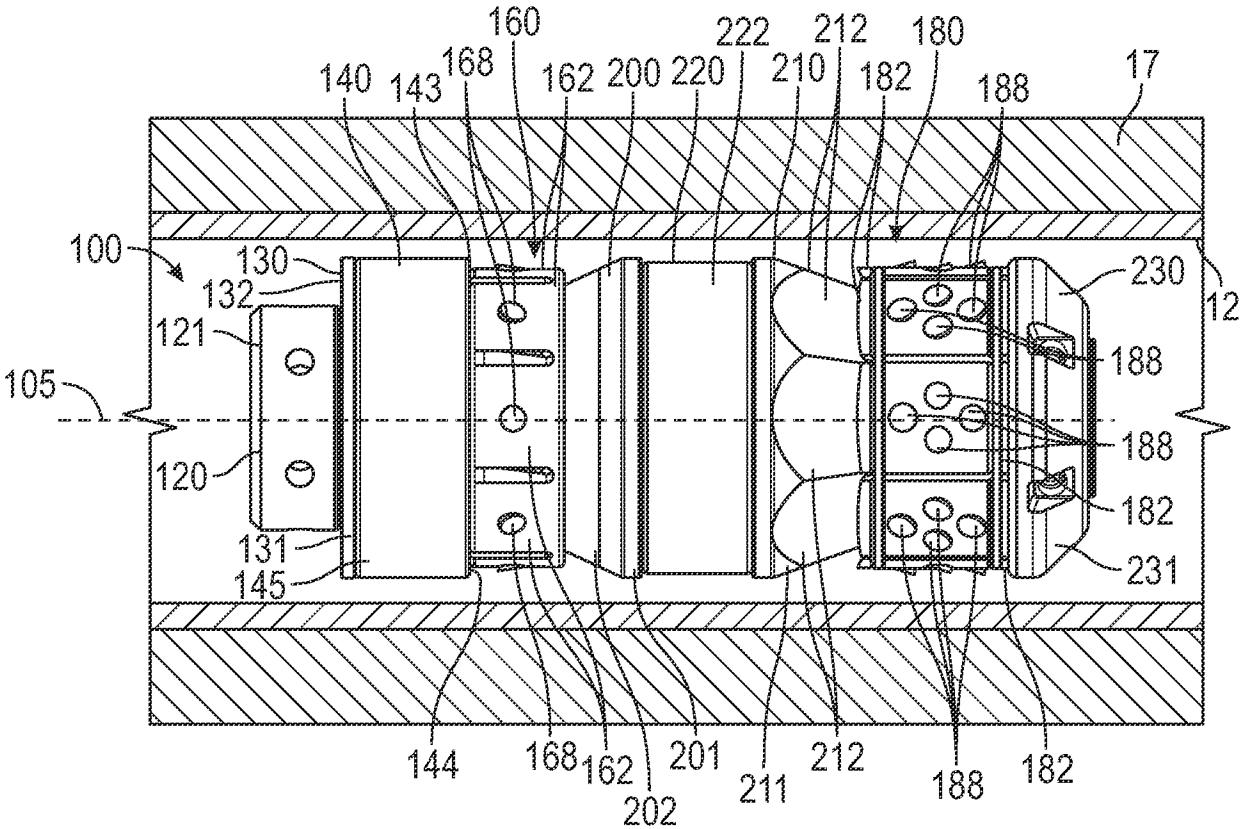
FIG. 2 is a schematic side view of an embodiment of a hybrid frac plug of the system of FIG. 1 in a first configuration.
Figure 3:
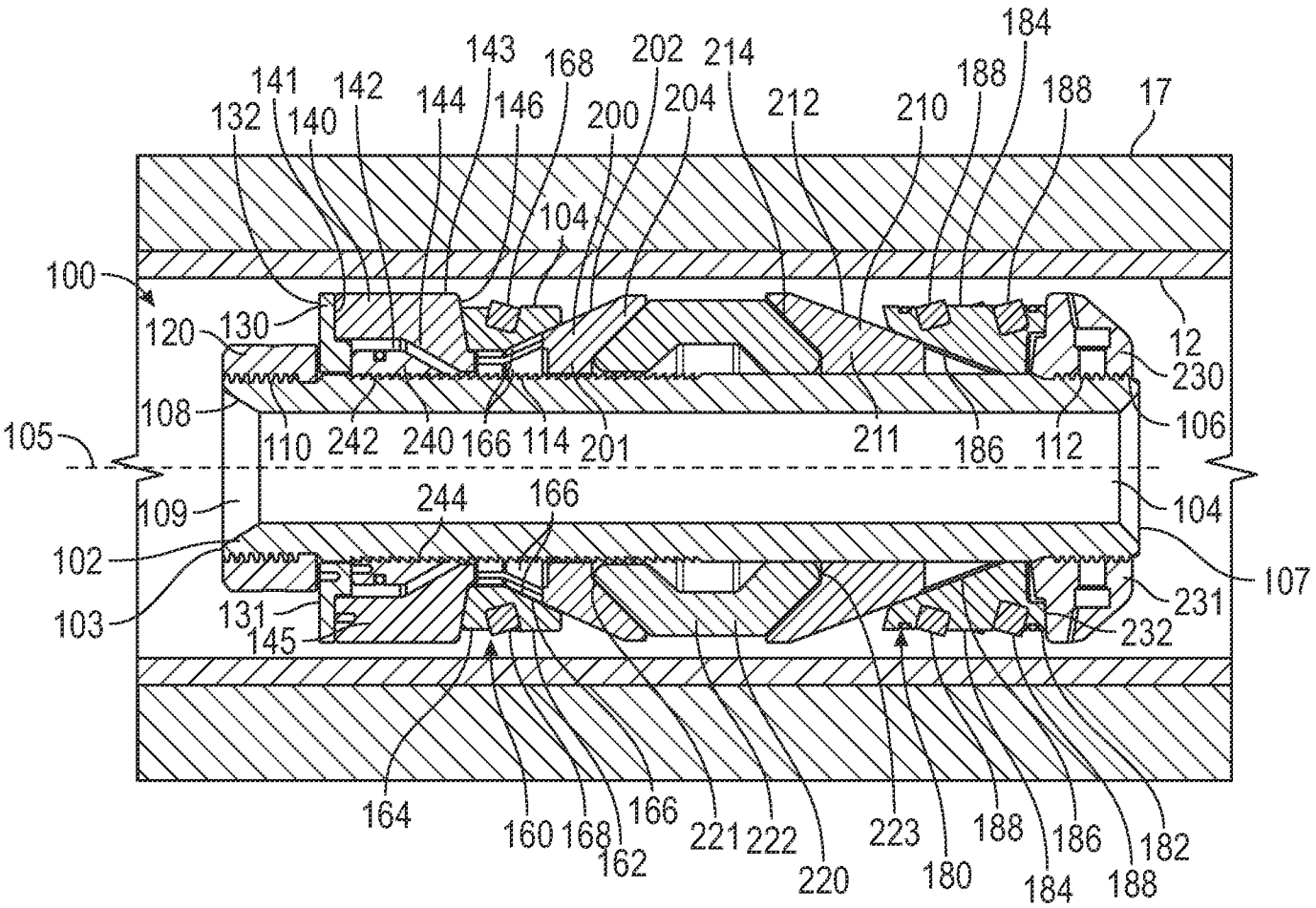
FIG. 3 is a side cross-sectional view of the plug of FIG. 2 in the first configuration.

Referring now to FIGS. 2 and 3, an embodiment of the frac plug 100 of fracking system 10 is shown. As described above, hybrid frac plug 100 is actuatable by setting tool 50 (not shown in FIGS. 2 and 3) from the run-in configuration (shown in FIGS. 2 and 3), to the deployed configuration which will be discussed further herein without a substantial focus on the setting tool 50.

In this exemplary embodiment, hybrid frac plug 100 has a central or longitudinal axis 105 and generally includes a mandrel 102, a mandrel collar 120, an annular compression ring 140, a first or uphole slip 160, a second or downhole slip 180, a pair of frustoconical members or ramps 200 and 210, an annular sealing element or packer 220, a nose or nose 230, and a lock ring 250. It may be understood that the configuration of hybrid frac plug 100 may vary in other embodiments. For instance, in other embodiments, hybrid frac plug 100 may not include each of the components shown in FIGS. 2 and 3, and/or may include components in addition to those shown in FIGS. 2 and 3. As an example, in other embodiments, hybrid frac plug 100 may include only a single slip rather than the pair of slips 160 and 180.

The mandrel 102 of hybrid frac plug 100 has a first end 103, a second end 107 longitudinally opposite the first end 103, and a generally cylindrical body 109 having a central bore or passage 104 extending between ends 103 and 107, and a generally cylindrical outer surface 106 also extending between ends 103 and 107. In this exemplary embodiment, an annular seat 108 is formed within central passage 104 at the first end 103 of mandrel 102. An obturating member or ball (not shown in FIGS. 2 and 3) conveyed by setting tool 50 with the hybrid frac plug 100 may sealingly engage the seat 108 of mandrel 102 to prevent fluid flow in a downhole direction (e.g., towards the toe of the wellbore 13) through the central passage 104 following the deployment of hybrid frac plug 100. The ball may however permit fluid flow in an uphole direction (e.g., towards the surface 5) and thus may act as a check valve only permitting fluid flow in the uphole direction through central passage 104 following the deployment of hybrid frac plug 100.

In this exemplary embodiment, the outer surface 106 includes a first connector 110 and a second connector 112 each formed thereon. The first connector 110 is located at the first end 103 of mandrel 102 and releasably (e.g., threadably) connects to the mandrel collar 120 of hybrid frac plug 100 while the second connector 112, which is located at the second end 107, releasably (e.g., threadably) connects to the nose 230 of hybrid frac plug 100. It may be understood that in other embodiments one of the mandrel collar 120 and nose 230 may instead be formed monolithically or be permanently coupled (e.g., welded, bonded, etc.) to the mandrel 102. In this exemplary embodiment, mandrel 102 additionally includes a plurality of circumferential engagement members or ratchet teeth 114 formed on the outer surface 106 thereof and located between connectors 110 and 112. As will be discussed further herein, the ratchet teeth 114 are configured couple with the lock ring 250 to thereby hold the hybrid frac plug 100 in the deployed configuration.

As described above, the mandrel collar 120 of hybrid frac plug 100 has an annular, ring shaped body 121 connected to the first end 103 of mandrel 102 and surrounds the first end 103 of mandrel 102. Mandrel collar 120 connects (e.g., via one or more fasteners and/or other mechanisms) with a piston of the setting tool 50 used to deploy the hybrid frac plug 100) such that the piston of the setting tool 50 is axially locked to the mandrel 102 whereby relative axial movement (e.g., along central axis 105) between the piston of setting tool 50 and mandrel 102 is restricted. It may be understood that in other embodiments mandrel 102 may couple directly to the piston of setting tool 50 and thus hybrid frac plug 100 may not include mandrel collar 120.

In this exemplary embodiment, compression ring 140 includes an annular retainer plate 130 which surrounds mandrel 102 and is positioned directly adjacent or abuts the compression ring 140 of hybrid frac plug 100. Retainer plate 130 has an annular, ring-shaped body 131 having an annular contact surface 132 facing the setting tool 50. Contact surface 132 is engaged by an outer sleeve of setting tool 50 (surrounding the piston of setting tool 50) that is displaced axially (e.g., along central axis 105) towards the hybrid frac plug 100 in response to the actuation of setting tool 50. Thus, retainer plate 130, along with compression ring 140, travels axially relative to mandrel 102 during the deployment of hybrid frac plug 100 in response to contact between retainer plate 130 and the sleeve of setting tool 50.

The compression ring 140 of hybrid frac plug 100 also surrounds mandrel 102 and has a first end 141, a second end 143 longitudinally opposite first end 141. Additionally, compression ring 140 has an annular, ring shaped body 145 defining ends 141 and 143. In this exemplary embodiment, an annular passage or chamber 142 is formed radially between the compression ring 140 and mandrel 102 and which is partially defined by an inclined inner engagement surface 144 of the compression ring 140 which faces the lock ring 250 of hybrid frac plug 100. Additionally, in this exemplary embodiment, the second end 143 of compression ring 140 defines an annular outer engagement surface 146 which acts against the uphole slip 160 of hybrid frac plug 100 during the deployment of plug 100. Outer engagement surface 146 may be inclined relative to central axis 105 to assist with radially expanding uphole slip 160 during the deployment of hybrid frac plug 100, as will be discussed further herein.

Slips 160 and 180 of hybrid frac plug 100 are configured to bite into and attach with the casing string 12 upon the deployment of plug 100. In this exemplary embodiment, uphole slip 160 comprises a plurality of circumferentially spaced slip bodies 162 each having a cylindrical outer face 164 and an internal or inner inclined surface 166. One or more engagement members or inserts 168 are positioned in the outer face 164. Similarly, in this exemplary embodiment, downhole slip 180 comprises a plurality of circumferentially spaced slip bodies 182 each having a cylindrical outer face 184 and an internal or inner inclined surface 186. One or more engagement members or inserts 188 are positioned in the outer face 184. Additionally, in this exemplary embodiment, each slip body 182 of downhole slip 180 comprises an arcuate engagement surface 190 configured to rotationally lock to the nose 230 of hybrid frack plug 100 whereby relative rotation between the slip bodies 182 and nose 230 is restricted. For example, the engagement surface 190 of each slip body 182 may comprise one or more notches or castellations received interlockingly in one or more corresponding notches or castellations of nose 230. However, in other embodiments, the slip bodies 182 of downhole slip 180 may not include the rotationally locked engagement surfaces 190, and instead, relative rotation may be permitted between slip bodies 182 and nose 230.

In this exemplary embodiment, inserts 168 and 188 of slips 160 and 180, respectively, comprise buttons formed from a hardened material such as, for example, a Carbide-containing material like Tungsten Carbide. It may be understood that the hardened material comprising inserts 168 and 188 may vary. The hardened material comprising inserts 168 and 188 is intended to pierce the relatively softer material forming the casing string 12 to thereby securely attach each slip body 162, 182, respectively, to the casing string 12. In other embodiments, the configuration of inserts 168, 188 may vary. For example, in other embodiments, inserts 168 and 188 may comprise arcuate or curved teeth or blades. In other embodiments, the engagement members 168 and 188 of slips 160 and 180, respectively, may not comprise inserts and instead may be integrally formed with slip bodies 162 and 182, respectively. In still other embodiments, slip bodies 162 and 182 may comprise integrally formed engagement members along with inserts 168 and 188.

In this exemplary embodiment, when hybrid frac plug 100 is in the run-in configuration, the slip bodies 162 and 182 of slips 160 and 180, respectively, are connected to each other such that each slip 160 and 180 forms a ring-shaped structure. However, when hybrid frac plug 100 is deployed, slips 160 and 180 radially expand whereby the connections between adjacently positions slip bodies 162 and 182, respectively, break to allow for said radial expansion. In this manner, slip bodies 162 and 182 are frangibly connected together whereby a circumferential spacing between each adjacently positioned slip body 162 and 182 increases as the hybrid frac plug 100 actuates from the run-in configuration to the deployed configuration. However, in other embodiments, slip bodies 162 and slip bodies 182 of slips 160 and 180, respectively, may be disconnected from each other even when hybrid frac plug 100 is in the run-in configuration.

The frustoconical ramps 200 and 210 of hybrid frac plug 100, which surround mandrel 102, radially expand the slip bodies 162 and 182 of slips 160 and 180 as the plug 100 is actuated into the deployed configuration. Frustoconical ramps 200 and 210 each have an annular, ring shaped body 201 and 211. Particularly, in this exemplary embodiment, the bodies 201 and 211 of ramps 200 and 210 are frustoconical in shape Ramps 200 and 210 have annular, generally frustoconical bodies 201 and 211. Additionally, in this exemplary embodiment, uphole ramp 200 includes an external, uphole ramp surface 202 while downhole ramp 210 includes a plurality of circumferentially spaced external, downhole ramp surfaces 212. Uphole ramp surface 202 is generally frustoconical in shape while downhole ramp surfaces 212 are each planar. A radially inner or internal surface of each of the slip bodies 162 of uphole slip 160 ride up the uphole ramp surface 202 of uphole ramp 200 during the deployment of hybrid frac plug 100 to thereby radially expand the slip bodies 162 such that inserts 168 may bite into and attach with the casing string 12. Similarly, a radially inner or internal surface of each of the slip bodies 182 of downhole slip 180 ride up a corresponding downhole ramp surface 212 of downhole ramp 210 during the deployment of hybrid frac plug 100 to thereby radially expand the slip bodies 182 such that inserts 188 may bite into and attach with the casing string 12.

Additionally, in this exemplary embodiment, the downhole ramp surfaces 212 of downhole ramp 210 interlock with radially inner or internal surfaces of the slip bodies 182 of downhole slip 180, thereby preventing relative rotation between downhole ramp 210 and downhole slip 180. The interlocking of downhole ramp 210 with downhole slip 180 prevents downhole slip 180 from free-spinning relative to downhole slip 180 (which is attached to the casing string 12 following the deployment of hybrid frac plug 100). As will be discussed further herein, with downhole ramp 210 prevented from free-spinning, a drill may more conveniently cut into and drill through the downhole ramp 210 (given that ramp 210 is prevented from rotating in concert with a cutting element of the drill) during the removal of hybrid frac plug 100. Additionally, while in this exemplary embodiment, the uphole ramped surface 202 of uphole ramp 200 is rounded, in other embodiments, uphole ramped surface 202 may comprise a plurality of circumferentially spaced, planar ramp surfaces which interlock with the uphole slip 160.

Ramps 200 and 210 each additionally include an internal compressive surface 204 and 214. Compressive surfaces 204 and 214 contact and act against longitudinally opposed ends 221 and 223 of the packer 220 of hybrid frac plug 100 to thereby axially compress the 220, reducing the axial length of the packer 220. As will be discussed further herein, the axial compression of packer 220 results in a corresponding radial (relative central axis 105) expansion of packer 220 into sealing engagement with casing string 12.

Packer 220 surrounds the mandrel 102 and is captured axially between the ramps 200 and 210. In this exemplary embodiment, packer 220 comprises a flexible, elastomeric material such as rubber or a flexible synthetic material such as a flexible polymer and the like. In addition to the ends 221 and 223 engaged by ramps 200 and 210, packer 220 includes a radially outer or external sealing surface 222 extending between ends 221 and 223 and which sealingly engages the casing string 12 during the deployment of the hybrid frac plug 100.

As described above, nose 230 of hybrid frac plug 100 has an annular, ring shaped body 231 which surrounds mandrel 102 and is coupled to the second end 107 of mandrel 102 via second connector 112. In this exemplary embodiment, nose 230 is annular in shape and includes an uphole facing, annular contact surface 232. Contact surface 232 of nose 230 contacts a downhole end of each of the slip bodies 182 of downhole slip 180 and forces the slip bodies 182 axially along the downhole ramp surface 212 of downhole ramp 210 during the deployment of hybrid frac plug 100.

Particularly, in response to the actuation of setting tool 50, the sleeve of the setting tool 50 applies a first, downhole-directed axial force against the contact surface 132 of retainer plate 130 which is transferred to compression ring 140 while the piston of the setting tool 50 concurrently applies a second, uphole-directed axial force (opposite in direction of the downhole-directed axial force) against the mandrel 102 which is transferred to the nose 230. In this manner, the downhole-directed force is applied from the compression ring 140 to both the upper slip 160 and upper ramp 200 while the uphole-directed force is applied from the nose 230 to both the lower slip 180 and lower ramp 210. The opposed downhole-directed and uphole-directed axial forces applied to ramps 200 and 210, respectively, are transferred to the ends 221 and 223 of packer 220, resulting in the axial compression and concomitant radial expansion of packer 220 during the deployment of hybrid frac plug 100.

As described above, the lock ring 240 of hybrid frac plug 100 holds or locks the plug 100 into the deployed configuration following the plug 100's deployment by setting tool 50. In this exemplary embodiment, lock ring 240 includes a plurality of engagement members or ratchet teeth 242 formed along a radially inner surface of the lock ring 240 and which matingly engage the ratchet teeth 114 of the mandrel 102. Lock ring 240 additionally includes a radially outer, inclined engagement surface 244. The mating, interlocking engagement of teeth 114 and 242 of mandrel 102 and lock ring 240, respectively, permits lock ring 240 to travel in a downhole axial direction (e.g., towards the inner engagement surface 144 of compression ring 140) relative to mandrel 102, but prevents lock ring 240 from travelling in an opposed, uphole axial direction (e.g., away from inner engagement surface 144) relative to mandrel 102. Thus, the interlocking engagement of teeth 114 and 242 forms a one-way ratchet between lock ring 240 and mandrel 102.

Specifically, during the deployment of hybrid frac plug 100, retainer plate 130 contacts lock ring 240 and forces lock ring 240 to travel axially in the downhole-direction from a first or run-in position to a second or deployed position that is axially spaced in the downhole-direction from the run-in position. Once the setting tool 50 releases from the deployed hybrid frac plug 100, interlocking engagement between teeth 114 and 242 of mandrel 102, lock ring 240, respectively, prevents lock ring 240 from returning to its initial run-in position. Additionally, contact between engagement surfaces 144 and 246 of compression ring 140 and lock ring 240, respectively, prevents upper ramp 200 from travelling uphole and releasing pressure against the packer 220. Thus, by remaining in the deployed position, lock ring 240 maintains the sealing pressure formed between sealing surface 222 of packer 220 and the casing string 12. Further, it may be understood that, in other embodiments, a mechanism other than lock ring 240 may be utilized for locking the hybrid frac plug 100 into the deployed configuration.

As described above, hybrid frac plug 100 is a hybrid dissolvable plug including both components which are configured to entirely corrode and dissolve after a predetermined period of time, and components which are resistant to corrosion and therefore must be drilled out at the conclusion of the fracking operation performed using fracking system 10. For example, the corrosion-resistant components of hybrid frac plug 100 may be drilled out by the coiled-tubing deployed drill 290 shown schematically in FIG. 5.

In this exemplary embodiment, mandrel 102, mandrel collar 120, compression ring 140, and nose 230 each comprise dissolvable components formed from or comprising materials configured to entirely corrode and dissolve after a predetermined period of time. Particularly, the bodies 109, 121, 131, 145, and 231 of mandrel 102, mandrel collar 120, compression ring 140, and nose 230, respectively, are formed from dissolvable materials. These particular components of hybrid frac plug 100, particularly nose 230, may free-spin and/or otherwise complicate and substantially delay the process of drilling out plug 100, and thus are formed from dissolvable materials so as to minimize the degree of difficulty (e.g., required weight on bit) and time required for drilling out hybrid frac plug 100 while also avoiding the substantial increase in costs associated with conventional dissolvable frac plugs. For example, nose 230 may be particularly difficult to remove by drilling (should it be left undissolved) given that it is located at the downhole end of plug 100 and thus will become loose and break free from the casing string 12 as the lower slip 180 of plug 100 is drilled out. The loose nose 230 will then act as a shield preventing the drill bit from drilling into the next plug. Thus, forming the nose 230 from a dissolvable material may mitigate the issues associated with drilling out hybrid frac plug 100 much more substantially than by forming other components, such as slips 160 and 180 as an example, from dissolvable materials.

Additionally, in this exemplary embodiment, slips 160 and 180 and ramps 200 and 210 comprise corrosion-resistant materials which must be drilled out at the conclusion of the fracking operation. Particularly, the bodies 162, 182, 201, and 211 of slips 160 and 180 and ramps 200 and 210, respectively, are formed from corrosion-resistant materials. Further, in at least some applications, the elastomeric packer 220 of hybrid frac plug 100 is also drilled out at the conclusion of the fracking operation. The components of hybrid frac plug 100 selected to be formed from corrosion-resistant materials are components which are generally less difficult and/or time consuming to drill out compared to the components of plug 100 are which are selected to be formed from dissolvable materials. As an example, slips 160 and 180 bit into the inner surface of casing string 12 and thus are typically prevented from free-spinning within casing string 12 as they are drilled out, reducing the difficulty in drilling out slips 160 and 180 from casing string 12.

The dissolvable components of hybrid frac plug 100 comprise materials configured to corrode and thereby dissolve when exposed to the wellbore conditions within casing string 12 for a sufficient period of time. Particularly, in this exemplary embodiment, the dissolvable components of hybrid frac plug 100 corrode when exposed to chlorine-containing water present within casing string 12. The chlorine-containing water which corrodes the dissolvable components of hybrid frac plug 100 may comprise the fracturing fluid pumped into casing string 12 during the fracking operation and/or wellbore fluids from earthen formation 17 which leak into casing string 12 following the perforation of casing string 12. The corrosion-selected materials comprising the dissolvable components of hybrid frac plug 100 entirely corrode so as to break-apart and essentially dissolve when exposed to wellbore conditions for a sufficient period of time such that the corroded/dissolved materials formerly comprising the dissolvable component may be flow-transported or pumped through the casing string 12.

In some embodiments, the corrosion-selected materials comprising the dissolvable components of hybrid frac plug 100 comprise at least one of a corrosion-selected magnesium alloy and a corrosion-selected aluminum alloy. These corrosion-selected magnesium and aluminum may be formed in a variety of ways including, for example, casting, extruding, forging, and bonding using powder metallurgy and casting. However, it may be understood that the corrosion-selected materials comprising the dissolvable components of hybrid frac plug 100 may vary. For example, other corrosion-selected materials may include degradable elastomers, dissolvable polymers, etc. Additionally, in this exemplary embodiment, each of the dissolvable components of hybrid frac plug 100 are coated with a corrosion-resistant material used to delay or otherwise control the dissolution of the dissolvable components of hybrid frac plug 100 such that the dissolvable components of plug 100 only dissolve after a predetermined period of time or "delay period" has elapsed that is greater than the anticipated period of time required for performing the fracking operation. The corrosion-resistant coating may comprise Xylan, Nylon dip, Teflon, and/or ceramic, etc.

As an example of the delay period, in some embodiments, the dissolvable components of hybrid frac plug 100 formed from corrosion-selected materials are configured to break apart and dissolve after a delay period of at least six hours. In some embodiments, the dissolvable components of hybrid frac plug 100 are configured to break apart and dissolve after a delay period of at least twelve hours. In certain embodiments, the dissolvable components of hybrid frac plug 100 are configured to break apart and dissolve after a delay period of at least twenty-four hours. However, it may be understood that the time required for performing a fracking operation may vary significantly from application to application, and thus the corresponding delay period may also vary substantially while remaining greater than the time required for performing the fracking operation of the particular application.

The materials comprising the corrosion-resistant materials of hybrid frac plug 100 of course vary from those comprising the dissolvable components and have a substantially greater degree of corrosion-resistance than the corrosion-selected materials of the dissolvable components. For example, one or more the corrosion-resistant components of hybrid frac plug 100 may comprise a corrosion-resistant composite material, a corrosion-resistant polymeric material, and a corrosion-resistant metallic material such as a corrosion-resistant steel alloy. Additionally, it may be understood that the corrosion-resistant materials of different corrosion-resistant components of hybrid frac plug 100 may vary from each other based on the function and needs (e.g., resistance to tensile loads, resistance to shear loads, etc.) of the particular corrosion-resistant component.

While in this exemplary embodiment each of the mandrel 102, mandrel collar 120, retainer plate 130, compression ring 140, and nose 230 are each dissolvable, in other embodiments one or more of the mandrel 102, mandrel collar 120, retainer plate 130, and compression ring 140 may be formed from or comprise corrosion-resistant materials which must be drilled out at the fracking of the fracking operation. However, nose 230 will generally remain a dissolvable component of hybrid frac plug 100 in order to avoid the issue of nose 230 becoming detached from lower slip 180 as the corrosion-resistant components of hybrid frac plug 100 are drilled out, thereby permitting the nose 230 to free-spin within casing string 12 which substantially increases the time and difficulty of drilling out the free-spinning nose 230. Nose 230 may be particularly difficult to drill out when permitted to free-spin given that nose 230 has a large outer diameter and axially-projected surface area (larger than the axially-projected surface area of mandrel 102, for example) that must be drilled by the coiled tubing-deployed drill utilized for drilling out the remaining corrosion-resistant components of hybrid frac plug 100.

By utilizing corrosion-selected materials for forming the nose 230 of hybrid frac plug 100, the issues associated with conventional corrosion-resistant frac plugs (e.g., extended time required for performing the fracking operation, difficulty in drilling out when located in long horizontal sections of the wellbore, etc.) may be largely mitigated given that the volume of corrosion-resistant materials of hybrid frac plug 100 (as a fraction of the total volume of plug 100) is reduced substantially compared with a similarly configured, conventional corrosion-resistant frac plug. To state in other words, the volume of the dissolvable components of hybrid frac plug 100 makes up a substantial share of the total volume of plug 100. For example, in some embodiments, the volume of the dissolvable components of hybrid frac plug 100 is 60% or greater of the total volume of the plug 100. In other embodiments, such as embodiments in which one or more of the mandrel 102, mandrel collar 120, retainer plate 130, and compression ring 140 are formed from corrosion-resistant materials, the volume of the dissolvable components of hybrid frac plug 100 may, while still forming a substantial share of the total volume of hybrid frac plug 100, be less than 50% of the total volume of plug 100.

By forming a substantial share of the total volume of hybrid frac plug 100 from dissolvable components, the volume of material of hybrid frac plug 100 needing to be drilled out at the conclusion of the fracking operation may is reduced substantially, in-turn reducing substantially the time required for drilling out the corrosion-resistant components of hybrid frac plug 100. Additionally, by forming the nose 230 and potentially other components of hybrid frac plug 100 from corrosion-selected materials, the difficulty in drilling out the remains of hybrid frac plug 100 may also be reduced substantially, particularly in applications in which the hybrid frac plug 100 is located within a relatively long horizontal section of a wellbore. As described above, due to the relatively surface area of nose 230, nose 230 may be particularly difficult to drill out given that it typically must be permitted to free-spin (due to its location at the downhole end of hybrid frac plug 100) at some point during the drilling out of the remains of hybrid frac plug 100.

However, it should be understood that a substantial share of the volume of hybrid frac plug 100 comprises corrosion-resistant components such as, for example, slips 160 and 180 and ramps 200 and 210. For example, in some embodiments, the volume of the corrosion-resistant components of hybrid frac plug 100 is 40% or greater of the total volume of the plug 100. Generally, the substantial portion of corrosion-resistant components of hybrid frac plug 100 are formed from corrosion-resistant materials which may be produced at a substantially lower cost than dissolvable materials, and thus, providing the hybrid frac plug 100 with a substantial component (e.g., 40% or more of the total volume) substantially reduces the cost of producing a given hybrid frac plug 100.

Additionally, a substantial portion or majority of the volume of corrosion-resistant components of hybrid frac plug 100 comprises the slips 160 and 180 of plug 100. As described above, slips 160 and 180 bite into and attach with the casing string 12 during the deployment of hybrid frac plug 100, and thus are typically prevented from free-spinning within casing string 12 as the remains of plug 100 are drilled out. Thus, while some time may be required for drilling out slips 160 and 180, the drilling out of slips 160 and 180 may not result in the substantial difficulties associated with drilling out components which are permitted to free-spin within casing string 12, including, for example, nose 230. In this manner, hybrid frac plug 100 provides a minimal cost alternative to conventional dissolvable frac plugs while avoiding the additional difficulties and limitations provided by conventional corrosion-resistant frac plugs, such as the difficulty of drilling out free-spinning components, particularly in applications where it is difficult to apply weight-on-bit (WOB) such as applications where the frac plug is located within a relatively long horizontal section of a wellbore.

Figure 4:
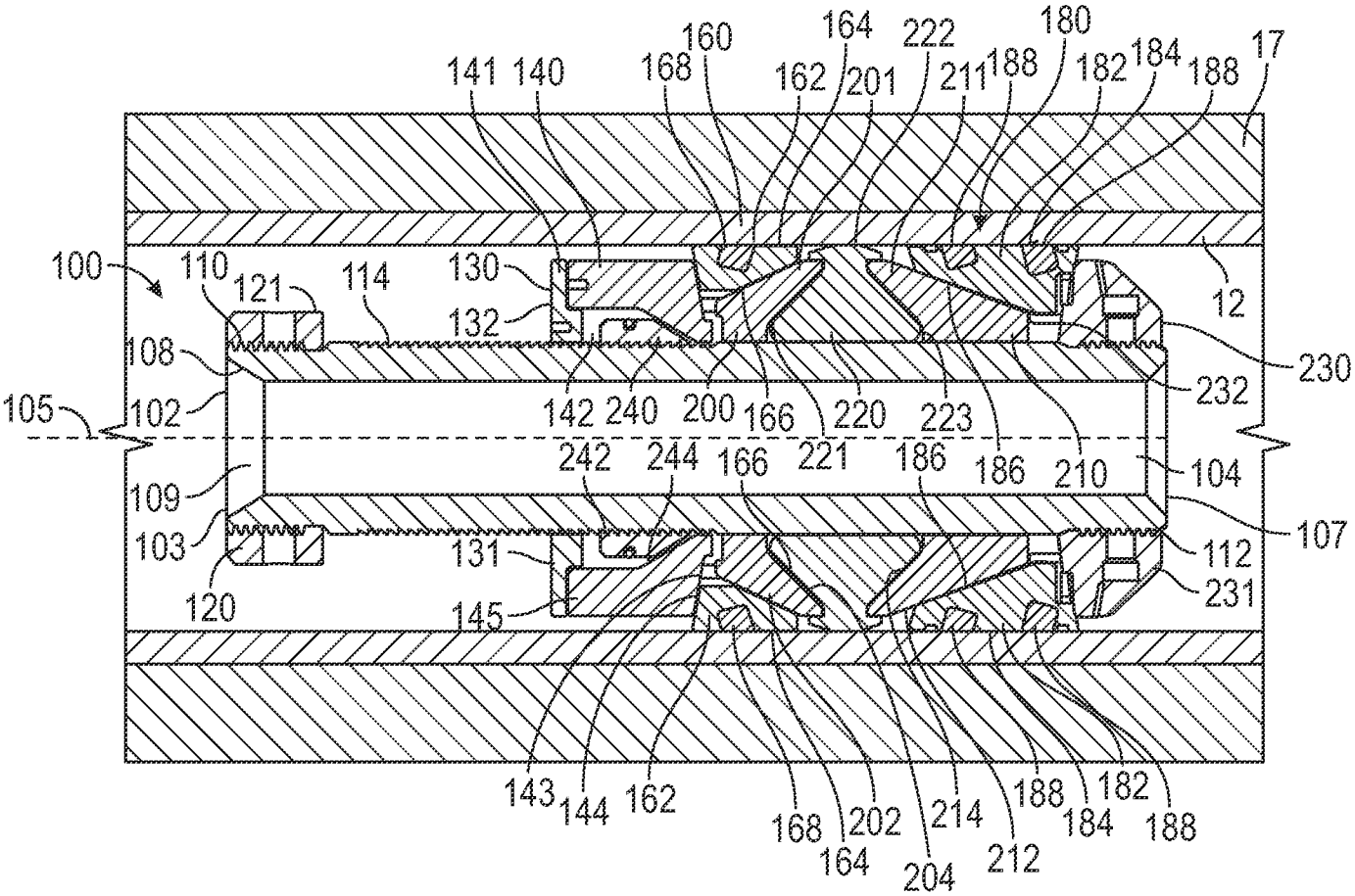
FIG. 4 is a side cross-sectional view of the plug of FIG. 2 in a second configuration.
Figure 6:
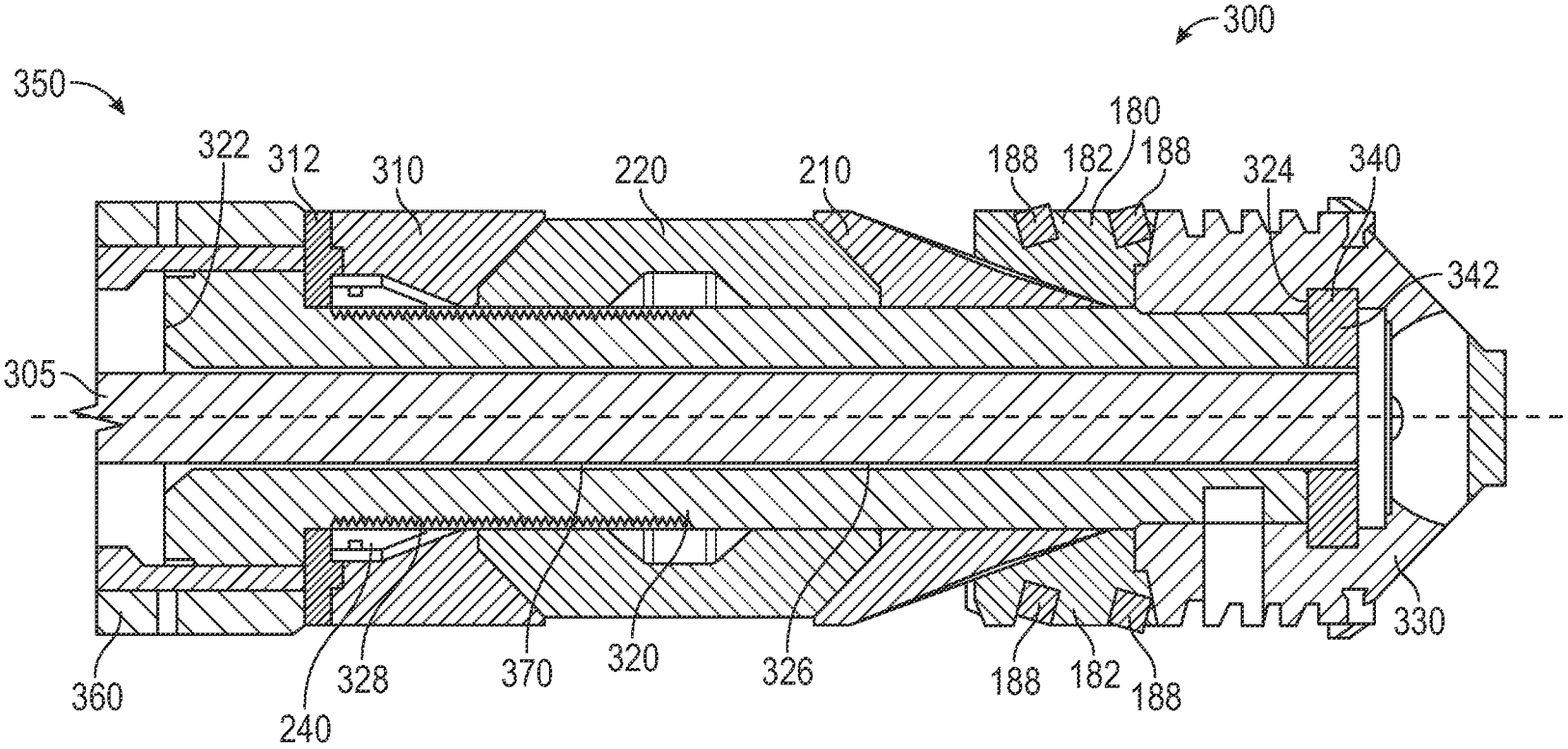
FIG. 6 is a side cross-sectional view of another embodiment of a hybrid frac plug.

It may be understood that other embodiments of hybrid frac plugs in accordance with principles disclosed herein may not include each of the components of hybrid frac plug 100 shown in FIGS. 2-4. For example, referring now to FIG. 6, another embodiment of a hybrid frac plug 300 is shown. Hybrid frac plug 300 incudes features in common with hybrid frac plug 100 described above, and shared features are labeled similarly. Hybrid frac plug 300 has a central or longitudinal axis 305 and generally includes an annular compression ring 310, an annular central core 320, lock ring 240, packer 220, downhole ramp 210, slip 180, and an annular nose 340 located at a downhole end of the hybrid frac plug 300. Unlike the hybrid frac plug 100 described above, hybrid frac plug 300 includes only a single slip 180 rather than the pair of slips 160 and 180. In this configuration, the uphole compression ring 310 (which includes an annular retainer plate 312 coupled therewith) and the downhole ramp 210 axially squeeze against and compress the packer 220 to displace an outer diameter of the packer 220 radially outwards from the central axis 305 of hybrid frac plug 300 when the plug 300 is actuated from a first or run-in configuration (shown in FIG. 6) to a second or set configuration with the packer 220 sealing against and the slip 180 anchored against a casing string (e.g., casing string 12).

In this exemplary embodiment, unlike hybrid frac plug 100 described above, hybrid frac plug 300 does not include a mandrel and instead includes the core 320 extending centrally through the hybrid frac plug 300 whereby the compressing ring 310, packer 220, downhole ramp 210, slip 180, and nose 340 each extend annularly around the core 320. Core 320 extends longitudinally between a first or uphole end 322 and a second or downhole end 324 opposite uphole end 322. Additionally, core 320 defines a central bore or passage 326 extending between ends 322 and 324, and a plurality of engagement members or ratchet teeth 328 formed on an outer surface of the core 320 for interfacing with the lock ring 240.

A setting tool 350 (partially shown in FIG. 6) is configured to couple with and actuate the hybrid frac plug 300 between the run-in and set configurations, the setting tool 350 including, among other features, an outer housing 360 and a centrally extending mandrel 370. A downhole end of the outer housing 360 of setting tool 350 abuts or contacts the retainer plate 312 of compression ring 310 and the mandrel 370 of setting tool 350 extends through the central passage 326 of the core 320 of hybrid frac plug 300. A downhole end of the mandrel 370 of setting tool 350 frangibly connects or couples to the nose 340 of hybrid frac plug 300 via a shear member or ring 342 frangibly connected between the downhole end of the mandrel 370 and the nose 340. Following actuation of the hybrid frac plug 300 into the set configuration, the shear ring 340 is configured to shear or separate thereby separating or decoupling the downhole end of mandrel 370 from the nose 340. With mandrel 370 separated from nose 340, the setting tool 350 may be retrieved to the surface leaving the hybrid frac plug 300 in the wellbore in the set configuration.

In this exemplary embodiment, hybrid frac plug 300 comprises a bottom-set plug in which the setting tool 350 connects to a downhole end of the plug 300 instead of to an uphole end of the plug 300. Additionally, mandrel 370 of setting tool 350 applies an uphole directed compressive force (directed towards the left side of the page in FIG. 6) directly to the nose 340 of hybrid frac plug 300 instead of through the core 320 of plug 300. Conversely, the hybrid frac plug 100 described above comprises a top-set plug in which a setting tool connects to the uphole end of plug 100.

Similar to hybrid frac plug 100, hybrid frac plug 300 includes both dissolvable components comprising corrosion-selected materials and corrosion-resistant components comprising corrosion-resistant materials. The corrosion-selected materials of hybrid frac plug 100 may be the same as or similar to the corrosion-selected materials of hybrid frac plug 100. Additionally, the corrosion-resistant materials of hybrid frac plug 300 may be the same as or similar to the corrosion-resistant materials of hybrid frac plug 100. In this exemplary embodiment, the compression ring 310, core 320, nose 340 are each dissolvable components and comprise corrosion-selected materials while the slip 180 comprises a corrosion-resistant material. In other embodiments, the compression ring 310 and/or core 320 may instead comprise corrosion-resistant components comprising corrosion-resistant materials. In some embodiments, the volume of the corrosion-resistant components of hybrid frac plug 300 is 40% or greater of the total volume of the plug 300. Similar to hybrid frac plug 100 described above, the substantial portion of corrosion-resistant components of hybrid frac plug 300 are formed from corrosion-resistant materials which may be produced at a substantially lower cost than dissolvable materials, and thus, providing the hybrid frac plug 300 with a substantial component (e.g., 40% or more of the total volume) substantially reduces the cost of producing a given hybrid frac plug 300.

Figure 7:
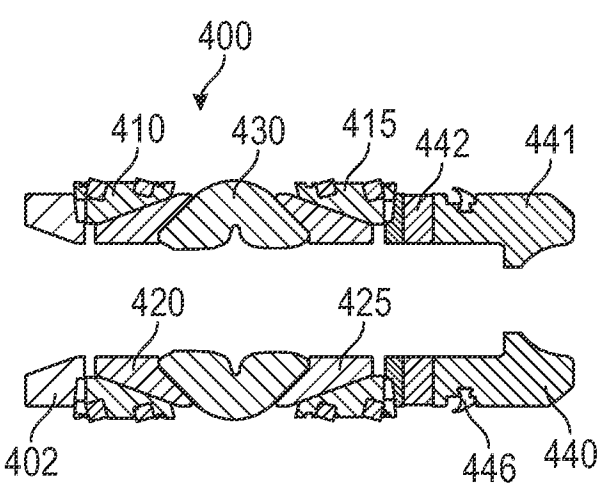
FIG. 7 is a side cross-sectional view of another embodiment of a hybrid frac plug and an accompanying setting tool.
Figure 7:
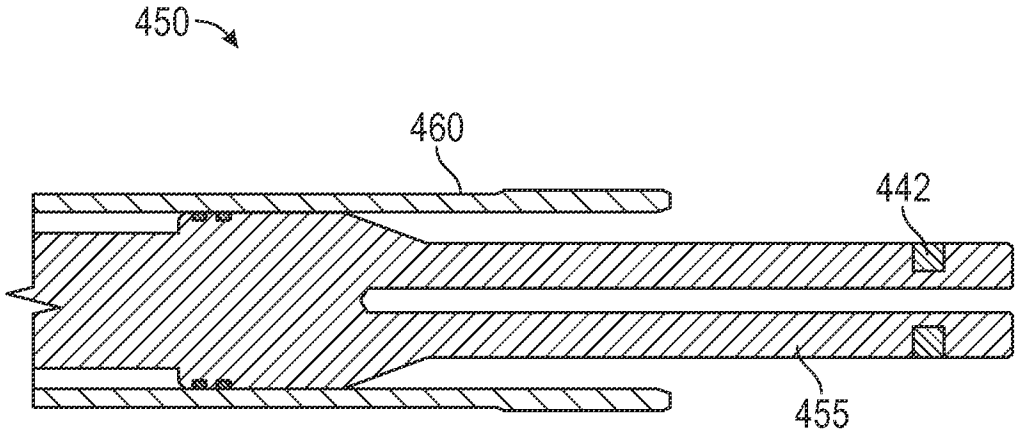

Referring now to FIG. 7, another embodiment of a bottom-set hybrid frac plug 400 is shown along with a setting tool 450 configured for setting the hybrid frac plug 400. Particularly, FIG. 7 illustrates hybrid frac plug 400 after being actuated into a set configuration by the setting tool 450 which has separated or disconnected from the hybrid frac plug 400. In this exemplary embodiment, hybrid frac plug 400 generally includes an annular compression ring 402 located at an uphole end of the hybrid frac plug 400, an annular first or uphole slip 410, a second or downhole slip 415, an annular first or uphole ramp 420, an annular second or lower ramp 425, an annular sealing element or packer 430, and an annular nose 440 disposed at a downhole end of the hybrid frac plug 400 opposite the compression ring 402.

Slips 410 and 415 of hybrid frac plug 400 are configured to bite into a casing string (e.g., casing string 12 shown in FIG. 1) when the hybrid frac plug 400 is in the set configuration to thereby resist axial movement of the slips 410 and 415 relative to the casing string. Additionally, slips 410 and 415 may be configured similarly as the slips 160 and 180 of the hybrid frac plug 100 described above. The ramps 420 and 425 of hybrid frac plug 400 are generally frustoconical and configured to guide the slips 410 and 415 as the slips 410 and 415 are directed radially outwards towards the casing string 12 as the hybrid frac plug 400 is actuated from a first or run-in configuration to the second or set configuration. In some embodiments, ramps 420 and 425 of hybrid frac plug 400 are configured similarly as the ramps 200 and 210 of the hybrid frac plug 100 described above. Further, packer 430 of hybrid frac plug 400 is configured to seal against the casing string (e.g., casing string 12 shown in FIG. 1) when the hybrid frac plug 400 is actuated into the set configuration, and packer 430 may be configured similarly as the packer 220 of hybrid frac plug 100.

The nose 440 of hybrid frac plug 400 connects the hybrid frac plug 400 to the setting tool 450 prior to the actuation of the hybrid frac plug 400 by the setting tool 450 from the run-in configuration to the set configuration. Particularly, in this exemplary embodiment, nose a shear member or ring 442 (shown sheared into two separate elements in FIG. 7) extends and is coupled between the nose 440 of hybrid frac plug 400 and a mandrel 455 of the setting tool 450 that is positioned at least partially within an outer housing 460 of the setting tool 450. In this exemplary embodiment, nose 440 includes a body 441 and an annular wiper 446 positioned along an outer periphery of the body 441 for wiping the casing string as the hybrid frac plug 400 is run downhole through the casing string. It may be understood that in some embodiments nose 440 may not include wiper 446. Although hybrid frac plugs 300 and 400 described herein are each bottom-set plugs, where the mandrel of the accompanying setting tool (e.g., mandrel 455 of setting tool 450) is used to apply an uphole directed axial force against the nose of the hybrid frac plug (e.g., nose 440 of plug 400) to set the plug, it may be noted that in this exemplary embodiment the hybrid frac plug 400 does not include an inner core extending axially through the surrounding annular components (e.g., compression ring 402, slips 410 and 415) of the plug 400.

Figure 8:
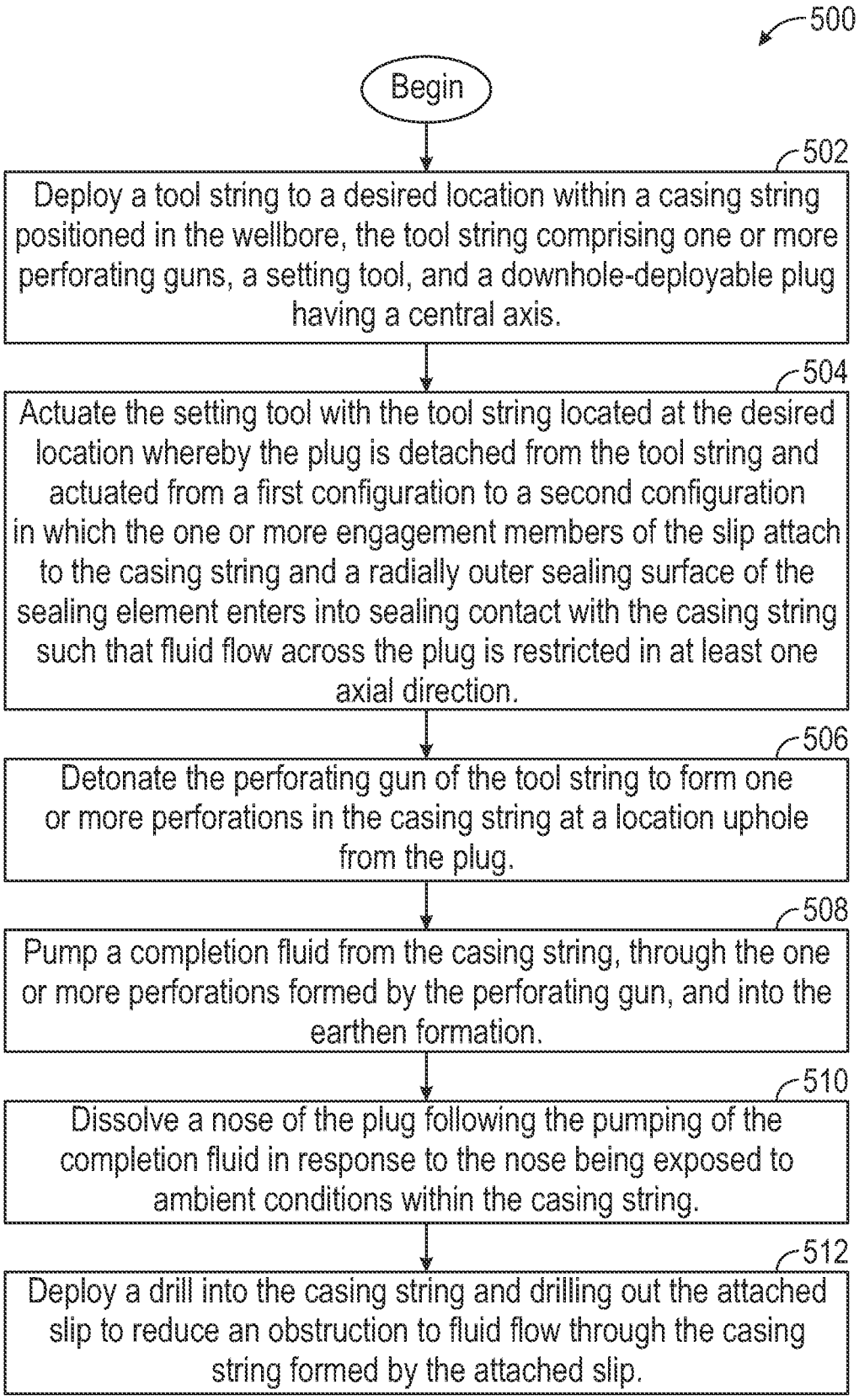
FIG. 8 is a flowchart of a method for preparing a cased subterranean wellbore for the production of subterranean fluids.

Similar to hybrid frac plugs 100 and 300 described above, hybrid frac plug 400 includes both dissolvable components comprising corrosion-selected materials and corrosion-resistant components comprising corrosion-resistant materials. The corrosion-selected materials of hybrid frac plug 100 may be the same as or similar to the corrosion-selected materials of hybrid frac plug 100. Additionally, the corrosion-resistant materials of hybrid frac plug 400 may be the same as or similar to the corrosion-resistant materials of hybrid frac plug 100. In this exemplary embodiment, the compression ring 402, nose 440 are each dissolvable components and comprise corrosion-selected materials while each slip 410 and 415 comprises a corrosion-resistant material. In other embodiments, the compression ring 402 may instead comprise a corrosion-resistant component comprising a corrosion-resistant material. In some embodiments, the volume of the corrosion-resistant components of hybrid frac plug 400 is 40% or greater of the total volume of the plug 400. Similar to hybrid frac plugs 100 and 300 described above, the substantial portion of corrosion-resistant components of hybrid frac plug 400 are formed from corrosion-resistant materials which may be produced at a substantially lower cost than dissolvable materials, and thus, providing the hybrid frac plug 400 with a substantial component (e.g., 40% or more of the total volume) substantially reduces the cost of producing a given hybrid frac plug 400. Referring now to FIG. 8, an embodiment of a method 500 is shown for preparing a cased subterranean wellbore for the production of subterranean fluids is shown. Beginning at block 502, method 500 includes deploying a tool string to a desired location within a casing string positioned in the wellbore, the tool string comprising one or more perforating guns, a setting tool, and a downhole-deployable plug having a central axis. In some embodiments, block 502 includes deploying the tool string 20 shown in FIG. 1 to a desired location within the casing string 12. Thus, in some embodiments, the plug deployed at block 502 comprises the hybrid frac plug 100 shown in FIGS. 2-5 including the mandrel 102, packer 220, and slips 160 and 180. In other embodiments, the plug deployed at block 502 may comprise the hybrid frac plug 300 shown in FIG. 6, the hybrid frac plug 400 shown in FIG. 7, or still other frac plugs which vary in configuration from both hybrid frac plugs 100, 300, and 400.

At block 504, method 500 comprises actuating the setting tool with the tool string located at the desired location whereby the plug is detached from the tool string and actuated from a first configuration to a second configuration in which the one or more engagement members of the slip attach to the casing string and a radially outer sealing surface of the sealing element enters into sealing contact with the casing string such that fluid flow across the plug is restricted in at least one axial direction. In some embodiments, block 504 includes actuating the setting tool 50 shown in FIG. 1 whereby the hybrid frac plug 100, hybrid frac plug 300, or hybrid frac plug 400 is actuated from the run-in configuration (shown in FIGS. 2 and 3 for plug 100 and in FIG. 6 for plug 300) to the deployed configuration (shown in FIG. 4 for plug 100 and in FIG. 7 for plug 400) described above whereby the slips of the plug 100, 300, or 400 attach to the casing string 12 and the packer 220 enters into sealing contact with the casing string 12.

At block 506, method 500 comprises detonating the perforating gun of the tool string to form one or more perforations in the casing string at a location uphole from the plug. In some embodiments, block 506 includes detonating the perforating gun 30 shown in FIG. 1 to form one or more perforations in the casing string 12 at a location uphole from the deployed hybrid frac plug 100. At block 508, method 500 comprises pumping a completion fluid from the casing string, through the one or more perforations formed by the perforating gun, and into the earthen formation. In some embodiments, block 508 includes pumping hydraulic fracturing fluid from the surface assembly 11 shown in FIG. 1, through the casing string 12 and one or more perforations formed by the perforating gun 30, and into the earthen formation 17.

Figure 5:
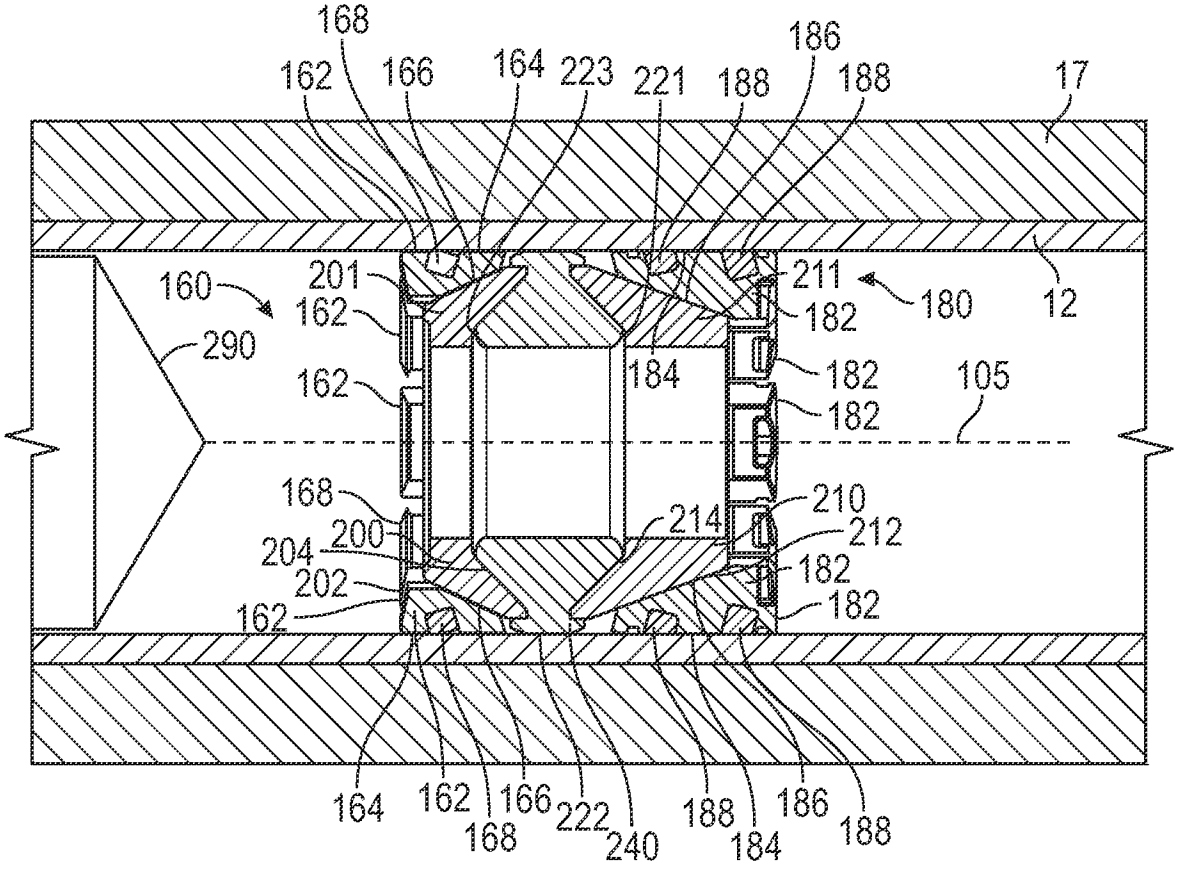
FIG. 5 is a side cross-sectional view of corrosion resistant components of the plug of FIG. 2 in the second configuration where dissolvable components of the plug have dissolved.

At block 510, method 500 comprises dissolving an annular nose body of a nose of the plug following the pumping of the completion fluid in response to the nose being exposed to ambient conditions within the casing string. In some embodiments, block 510 includes dissolving the nose 230 of hybrid frac plug 100 as shown particularly in FIG. 5. In other embodiments, block 510 includes dissolving the nose 340 of hybrid frac plug 300 shown in FIG. 6. In still other embodiments, block 510 includes dissolving the nose 440 of hybrid frac plug 400 shown in FIG. 7. In some embodiments, block 510 may additionally include dissolving the mandrel 102, mandrel collar 120, compression ring 140 of the hybrid frac plug 100 as shown in FIG. 5. In certain embodiments, block 510 may additionally include dissolving the core 320 and/or compression ring 310 of hybrid frac plug 300. In certain embodiments, block 510 may include dissolving the compression ring 402 of hybrid frac plug 400. At block 512, method 500 comprises deploying a drill into the casing string and drilling out the attached slip to reduce an obstruction to fluid flow through the casing string formed by the attached slip. In some embodiments, block 512 includes deploying the drill 290 (shown in FIG. 5) into the casing string 12 as shown in FIG. 5, and drilling out the attached slips 160 and 180 of hybrid frac plug 100 to reduce an obstruction to fluid flow through the casing string 12 formed by the attached slips 160 and 180. In some embodiments, block 512 also includes drilling out by drill 290 the packer 220 of hybrid frac plug 100. In certain embodiments, block 512 includes drilling out the slip 180 of hybrid frac plug 300. In some embodiments, block 512 includes drilling out each slip 410 and 415 of hybrid frac plug 400.

Method 500 may include method steps in addition to those shown in FIG. 5. For example, in some embodiments, method 500 includes determining whether the plug became loose following its actuation into the second configuration such that the plug was transported through the casing string from an initial and desired set position to a second set position spaced from the initial set position. Once becoming loose, the plug may be inadvertently pumped downhole through the casing string until it lands against the next plug positioned downhole from the loose plug. The inadvertent transportation of the loose plug may be detected by determining a position of the loose plug based on an increased resistance to the downhole progression of the drill bit through the casing string. This increased resistance may be registered at the surface as increased WOB applied to the drill bit. A position of the loose plug may thus be estimated from an estimated position of the drill bit in the casing string correlated with the registered increase in the resistance to the progression of the drill bit through the casing string.

This estimated position of the loose plug may then be compared with the initial set position of the loose plug which is predetermined based on the estimated position of the plug in the casing string when it is actuated into the set configuration. Thus, by determining a difference between the estimated position of the loose plug and the predetermined position of the plug, it may be determined that the plug failed to latch against the casing string and instead was inadvertently transported through the casing string. In some embodiments, this information may be used to re-frack the portion of the casing string associated with the loose plug. It may also be understood that the process of determining whether a given plug has been transported through the casing string from an initial set position may be performed for multiple plugs disposed in the casing string.

The relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A plug deployable as part of a tool string into a wellbore having a casing string positioned therein, the plug comprising:

an annular elastomeric sealing element comprising a radially outer sealing surface configured to extend outwardly from a central axis of the plug and sealingly press against an inner surface of the casing string when the plug is in the second configuration;

a slip comprising at least one slip body formed from a non-corrosive material configured to resist corrosion when exposed to conditions in the wellbore, wherein the slip body has a peripheral outer face oriented to face away from the central axis and toward the casing string, and one or more engagement members located on the outer face of the non-corrosive slip body wherein the one or more engagement members are configured to bite into the casing string when the plug is in the second configuration to thereby resist axial movement of the slip relative to the casing string;

an elongate mandrel having a first end, a second end longitudinally opposite the first end, and an outer surface extending from the first end to the second end, wherein the first end is configured to connect to a setting tool of the tool string for receiving an axially directed force transferrable through the mandrel and against the sealing element to force the sealing surface of the sealing element, which surrounds the mandrel, into sealing engagement with the casing string; and a nose coupled to the second end of the mandrel and having an annular nose body located at a downhole end of the plug and formed from a corrosion-selected material configured to dissolve when exposed to conditions in the wellbore following a predetermined delay period, wherein the nose is configured to apply an axially directed force against the sealing element to force the sealing surface of the sealing element into sealing engagement with the casing string;

wherein the plug comprises:

a run-in configuration having a run-in maximum outer diameter configured to travel along and within the casing string;

a first deployed configuration having a deployed maximum outer diameter that is greater than the run-in maximum outer diameter whereby an axially directed force applied by the nose via the mandrel causes radial expansion of the slip toward contact with the casing string so as to restrict relative rotation between the slip and the casing string, wherein the plug further comprises a lock ring having rachet teeth configured to engage with corresponding teeth formed on the mandrel so as to restrict relative movement between the mandrel and the lock ring, and wherein in the first deployed configuration relative rotation is restricted between the nose and the casing string via an intermediate connection formed between the nose and the rotationally locked slip; and a second deployed configuration in which the mandrel and the nose are dissolved but the slip remains in contact with the casing string restricting relative rotation therebetween.

2. The plug according to claim 1, wherein the annular nose body comprises at least one of a magnesium alloy and an aluminum alloy.

3. The plug according to claim 1, wherein the annular nose body comprises a non-corrosive coating encapsulating the corrosion-selected material.

4. The plug according to claim 1, further comprising:

a slip retainer having an annular retainer body extending around the outer surface of the mandrel and having an annular engagement surface in contact with an end of the slip, and wherein the slip is positioned axially between the slip retainer and the sealing element;

wherein the annular retainer body comprises a corrosion-selected material configured to dissolve following a predetermined delay period.

5. The plug according to claim 1, further comprising:

a ramp having an annular ramp body having an inclined engagement surface extending at an acute angle radially outwards from the central axis, and wherein a radially inner surface of the at least one slip body of the slip is positioned on the inclined engagement surface when the plug is in the first deployed configuration;

wherein the annular ramp body comprises a non-corrosive material.

6. The plug according to claim 1, wherein at least 40% of a total volume of the plug is formed from corrosion-selected materials and at least 30% of the total volume of the plug is formed from non-corrosive materials.

7. The plug according to claim 6, wherein more than 50% of a total volume of the plug is formed from corrosion-selected materials.

8. A plug deployable as part of a tool string into a wellbore having a casing string positioned therein, the plug comprising:

an annular elastomeric sealing element comprising a radially outer sealing surface configured to extend outwardly from a central axis of the plug and sealingly press against an inner surface of the casing string when the plug is in a first deployed configuration; and a slip comprising at least one slip body formed from non-corrosive materials configured to resist corrosion when exposed to conditions in the wellbore, wherein the at least one slip body has a peripheral outer face oriented to face away from the central axis and towards the casing string, and one or more engagement members located on the outer face of the slip body wherein the one or more engagement members are configured to bite into the casing string when the plug is in the first deployed configuration to thereby resist axial movement of the slip relative to the casing string;

an elongate mandrel having a first end, a second end longitudinally opposite the first end, and an outer surface extending from the first end to the second end, wherein the first end is configured to connect to a setting tool of the tool string for receiving an axially directed force transferrable through the mandrel and against the sealing element to force the sealing surface of the sealing element, which surrounds the mandrel, into sealing engagement with the casing string;

wherein the plug comprises:

a run-in configuration having a run-in maximum outer diameter configured to travel along and within the casing string;

the first deployed configuration has a deployed maximum outer diameter that is greater than the run-in maximum outer diameter whereby an axially directed force applied through the mandrel causes radial expansion of the slip toward contact with the casing string so as to restrict relative rotation between the slip and the casing string, wherein the plug further comprises a lock ring having rachet teeth configured to engage with corresponding teeth formed on the mandrel so as to restrict relative movement between the mandrel and the lock ring, and wherein in the first deployed configuration relative rotation is restricted between the mandrel and the casing string via an intermediate connection formed between the mandrel and the rotationally locked slip; and a second deployed configuration in which the mandrel is dissolved but the slip remains in contact with the casing string restricting relative rotation therebetween.

9. The plug according to claim 8, wherein more than 50% of a total volume of the plug is formed from corrosion-selected materials.

10. The plug according to claim 8, wherein at least 60% of a total volume of the plug is formed from corrosion-selected materials.

11. The plug according to claim 8, further comprising:

a nose having an annular nose body located at a downhole end of the plug, wherein the nose is configured to apply an axially directed force against the sealing element to force the sealing surface of the sealing element into sealing engagement with the casing string when the plug is in the first deployed configuration;

wherein the annular nose body of the nose comprises a corrosion-selected material.

12. The plug according to claim 8, wherein the corrosion-selected materials comprise at least one of a magnesium alloy and an aluminum alloy.

13. The plug according to claim 8, wherein the corrosion-selected materials are encapsulated in a non-corrosive coating.

14. The plug according to claim 8, further comprising:

a slip retainer having an annular retainer body extending around the outer surface of the mandrel and having an annular engagement surface in contact with an end of the slip, and wherein the slip is positioned axially between the slip retainer and the sealing element;

wherein the annular retainer body comprises a corrosion-selected material configured to dissolve following a predetermined delay period.

15. The plug according to claim 8, further comprising:

a ramp having an annular ramp body having an inclined engagement surface extending at an acute angle radially outwards from the central axis, and wherein a radially inner surface of the at least one slip body of the slip is positioned on the inclined engagement surface when the plug is in the first deployed configuration;

wherein the annular ramp body comprises a non-corrosive material.

16. The plug according to claim 8, wherein at least some of the non-corrosive materials are in direct contact with the casing string and at least some of the corrosion-selected materials are connected to the casing string through the non-corrosive materials in direct contact with the casing string when the plug is in the first deployed configuration.

17. A method for preparing a cased subterranean wellbore for the production of subterranean fluids, the method comprising:

(a) deploying a tool string to a desired location within the casing string positioned in the wellbore, the tool string comprising one or more perforating guns, a setting tool, and a downhole-deployable plug in a run-in configuration having a central axis and a run-in maximum outer diameter configured to travel along and within the casing string, wherein the plug comprises an annular elastomeric sealing element, a slip comprising at least one non- corrosive slip body having a radially outer face, a nose comprising a corrosion-selected nose body located at a downhole end of the plug, an elongate mandrel having a first end coupled to the setting tool and a longitudinally opposed second end coupled to the nose, and one or more engagement members located on the outer face of the slip body;

(b) actuating the setting tool with the tool string located at the desired location whereby the plug is actuated from the run-in configuration to a first deployed configuration having a deployed maximum outer diameter that is greater than the run-in maximum diameter and in which the one or more engagement members of the slip attach to the casing string and a radially outer sealing surface of the sealing element enters into sealing contact with the casing string such that fluid flow across the plug is restricted in at least one axial direction, wherein the plug further comprises a lock ring having rachet teeth configured to engage with corresponding teeth formed on the mandrel so as to restrict relative movement between the mandrel and the lock ring, wherein in the first deployed configuration relative rotation is restricted between the nose and the casing string via an intermediate connection formed between the nose and the rotationally locked slip;

(c) activating the perforating gun of the tool string to form one or more perforations in the casing string at a location uphole from the plug;

(d) pumping a completion fluid from the casing string, through the one or more perforations formed by the perforating gun, and into an earthen formation;

(e) dissolving the corrosion-selected nose body of the plug following (d) in response to the nose being exposed to conditions in the wellbore following a predetermined delay period whereby the plug is shifted from the first deployed configuration to a second deployed configuration in which the mandrel and the nose are dissolved but the slip remains in contact with the casing string restricting relative rotation between the slip and the casing string; and (f) deploying a drill into the casing string and drilling out the attached non-corrosive slip body following the dissolving of the nose body to reduce an obstruction to fluid flow through the casing string formed by the attached slip.

18. The method according to claim 17, wherein at least 40% of a total volume of the plug is formed from corrosion-selected materials and at least 30% of the total volume of the plug is formed from non-corrosive materials.

19. The method according to claim 18, wherein more than 50% of a total volume of the plug is formed from corrosion-selected materials.

20. The method according to claim 17, further comprising:

(g) applying an axially directed force by the nose against the sealing element to force the sealing surface of the sealing element into sealing engagement with the casing string.

21. The method according to claim 17, wherein actuating the setting tool results in the disconnection of the plug from the tool string following the actuation of the plug into the first deployed configuration.

22. A method for preparing a cased subterranean wellbore for the production of subterranean fluids, the method comprising:

(a) performing multiple hydraulic fracturing operations in a progression moving from a downhole end of the wellbore toward an uphole end wherein each fracturing operation comprises:

(i) deploying a unique tool string into the wellbore to a unique pre-determined location within the casing string located in the wellbore, the tool string comprising at least one perforating gun, a setting tool, and a hybrid frac plug in a run-in configuration having a run-in maximum outer diameter configured to travel along and within the casing string and located at a downhole end of the tool string wherein the hybrid frac plug includes a corrosion-selected nose, an annular elastomeric sealing element, an elongate mandrel having a first end coupled to the setting tool and a longitudinally opposed second end coupled to the nose, and at least one non-corrosive slip, between the ends of the hybrid frac plug is located the sealing element and the at least one non-corrosive slip where the sealing element extends continuously circumferentially around a central axis of the hybrid frac plug along an outer periphery of the hybrid frac plug;

(ii) actuating the setting tool to impose axially directed forces against the sealing element of the hybrid frac plug to set the hybrid frac plug and transition the sealing element and the at least one non-corrosive slip from the run-in configuration to a sealing, first deployed configuration having a deployed maximum outer diameter that is greater than the run-in maximum diameter and where the at least one non-corrosive slip bites into the casing string resisting relative movement between the casing string and the hybrid frac plug while the sealing element extends towards and sealingly presses against an inner surface of the casing preventing fluid flow across the hybrid frac plug in at least a downhole direction, wherein the hybrid frac plug further comprises a lock ring having rachet teeth configured to engage with corresponding teeth formed on the mandrel so as to restrict relative movement between the mandrel and the lock ring, and wherein in the first deployed configuration relative rotation is restricted between the nose and the casing string via an intermediate connection formed between the nose and the rotationally locked slip;

(iii) detaching the hybrid frac plug from the tool string;

(iv) firing the at least one perforating gun to puncture perforations in the casing string; and (v) pressurizing the portion of the casing string located uphole from the hybrid frac plug with hydraulic fracturing fluid to fracture, expand and extend the perforations into a subterranean earthen formation surrounding the wellbore while the hybrid frac plug prevents the pressurized fracturing fluid from proceeding further through the casing string downhole from the hybrid frac plug;

(b) dissolving the corrosion-selected nose of each of the hybrid frac plugs no sooner than six hours after each the hybrid frac plugs have been set while the at least one non-corrosive slip and the sealing element of each hybrid frac plug is preserved in place as set after each of the hybrid frac plugs have been set and whereby each of the hybrid frac plugs are shifted from the first deployed configuration to a second deployed configuration in which the mandrel and the nose are dissolved but the slip remains in contact with the casing string restricting relative rotation therebetween;

(c) clearing the casing string of the at least one non-corrosive slip and the sealing element of each of the hybrid frac plugs with a drill system where the drill system whereby engagement between a drill bit of the drill system and the at least one non-corrosive slip and the sealing element of each hybrid frac plug is registered as an increase in resistance to the downhole progression of the drill bit through the casing string;

(d) determining a position of each of the hybrid frac plugs estimated from the registered increase in resistance to the downhole progression of the drill bit; and (e) comparing the determined position of each of the hybrid frac plugs with a predetermined location of each of the hybrid frac plugs in the casing string to determine if any of the hybrid frac plugs have moved axially within the casing string after being transitioned to the first deployed configuration.

* * * * *